US008383920B2

(12) United States Patent
Komatsu et al.

(10) Patent No.: US 8,383,920 B2
(45) **Date of Patent: *Feb. 26, 2013**

(54) KEYBOARD APPARATUS

(75) Inventors: Akihiko Komatsu, Hamamatsu (JP); Nariyasu Yaguchi, Hamamatsu (JP); Yoshinori Hayashi, Iwata (JP)

(73) Assignee: Yamaha Corporation (JP)

( * ) Notice: Subject to any disclaimer, the term of this patent is extended or adjusted under 35 U.S.C. 154(b) by 63 days.

This patent is subject to a terminal disclaimer.

(21) Appl. No.: 12/823,931

(22) Filed: Jun. 25, 2010

(65) Prior Publication Data

US 2011/0067557 A1 Mar. 24, 2011

(30) Foreign Application Priority Data

Jun. 25, 2009 (JP) ..... 2009-151649
Jun. 25, 2009 (JP) ..... 2009-151650
Aug. 25, 2009 (JP) ..... 2009-194675

(51) Int. Cl.
*G10F 1/02* (2006.01)

(52) U.S. Cl. ..... 84/17; 84/20; 84/23

(58) Field of Classification Search ..... 84/17, 20–23
See application file for complete search history.

(56) References Cited

U.S. PATENT DOCUMENTS 4,194,428 A 3/1980 McFarlin
5,451,706 A * 9/1995 Yamamoto et al. ..... 84/34
5,714,702 A * 2/1998 Ishii ..... 84/462
5,880,389 A * 3/1999 Muramatsu ..... 84/615
5,994,632 A * 11/1999 Muramatsu et al. ..... 84/18
6,525,257 B1 * 2/2003 Hermann ..... 84/658
6,781,046 B2 * 8/2004 Meisel ..... 84/20
6,888,052 B2 * 5/2005 Meisel ..... 84/16
6,891,092 B2 * 5/2005 Meisel ..... 84/16
7,019,201 B2 * 3/2006 Meisel ..... 84/16

(Continued)

FOREIGN PATENT DOCUMENTS

DE 44 14 110 A1 11/1995
EP 2 015 289 A2 1/2009

(Continued)

OTHER PUBLICATIONS

Extended European Search Report issued Nov. 3, 2010 for EP 1016696.1; Cited in related co-pending SN. U.S. Appl. No. 12/823,955 (see USPGP Cite 1)

(Continued)

*Primary Examiner* — David S. Warren
(74) *Attorney, Agent, or Firm* — Rossi, Kimms & McDowell LLP

(57) ABSTRACT

A keyboard apparatus includes a key supported for pivoting movement about a pivot point, a mass member for imparting a reaction force to performance operation of the key in interlocked relation to the key, a transmission member provided in abutment with both of the key and mass member to transmit a load from one of the key and mass member to the other, and an electromagnetic actuator for driving, via a fixed coil, the transmission member toward at least one of the key or mass member. Good key touch feeling can be achieved not only by a load applied from the mass member to the key but also through load control by the actuator. Thus, it is possible to faithfully reproduce a key touch feeling approximate to that in a natural keyboard instrument, such as an acoustic piano, with a simple construction and facilitated control.

11 Claims, 24 Drawing Sheets

U.S. PATENT DOCUMENTS

| | | | | |
|---|---|---|---|---|
| 7,166,795 | B2 * | 1/2007 | Lengeling | 84/737 |
| 7,238,868 | B2 * | 7/2007 | Muramatsu et al. | 84/20 |
| 7,547,833 | B2 * | 6/2009 | Yamashita | 84/18 |
| 7,786,368 | B2 * | 8/2010 | Muramatsu | 84/615 |
| 8,138,402 | B2 * | 3/2012 | Komatsu | 84/22 |
| 2001/0000569 | A1 * | 5/2001 | Meisel | 84/688 |
| 2001/0037723 | A1 * | 11/2001 | Nishida et al. | 84/744 |
| 2002/0184989 | A1 * | 12/2002 | Meisel | 84/216 |
| 2005/0139060 | A1 * | 6/2005 | Muramatsu | 84/719 |
| 2005/0188810 | A1 * | 9/2005 | Meisel | 84/16 |
| 2009/0013856 | A1 * | 1/2009 | Fujiwara et al. | 84/626 |
| 2009/0019997 | A1 * | 1/2009 | Muramatsu | 84/626 |
| 2009/0100986 | A1 | 4/2009 | Komatsu | |
| 2010/0031803 | A1 | 2/2010 | Lozada et al. | |
| 2010/0229708 | A1 * | 9/2010 | Komatsu | 84/22 |
| 2010/0326257 | A1 * | 12/2010 | Yaguchi et al. | 84/687 |
| 2010/0326260 | A1 * | 12/2010 | Komatsu et al. | 84/744 |
| 2011/0067557 | A1 * | 3/2011 | Komatsu et al. | 84/744 |

FOREIGN PATENT DOCUMENTS

| | | | |
|---|---|---|---|
| FR | 2 704 968 | A1 | 11/1994 |
| FR | 2 902 538 | A1 | 12/2007 |
| GB | 2 331 831 | A | 6/1999 |
| JP | 2956180 | B2 | 10/1999 |
| JP | 3644136 | B2 | 4/2005 |
| JP | 2005-195619 | A | 7/2005 |
| RU | 2 084 967 | C1 | 7/1997 |
| WO | 98/13817 | A1 | 4/1998 |

OTHER PUBLICATIONS

CN OA issued Feb. 22, 2012 for corres. CN201010220096.4 (English translation provided).

Extended European Search Report issued in corresponding European Patent Application No. 10166965.3 dated Feb. 8, 2011.

Partial European Search Report issued in corresponding EP 10166965.3 dated Nov. 8, 2010.

* cited by examiner

| | 1ST KEY-DEPRESSION LOAD P1 | | 2ND KEY-DEPRESSION LOAD P2 | | 3RD KEY-DEPRESSION LOAD P3 | | 4TH KEY-DEPRESSION LOAD P4 | |
|---|---|---|---|---|---|---|---|---|
| | START POSITION (mm) | INSTRUCTION VALUE (N) | START POSITION (mm) | INSTRUCTION VALUE (N) | START POSITION (mm) | INSTRUCTION VALUE (N) | START POSITION (mm) | MAXIMUM VALUE (N) |
| | 0.5 | −0.2 | 3 | +0.5 | 5.2 | +0.3 | 6 | +0.9 |
| TOTAL VALUE OF LOADS (N) | −0.2 | | +0.3 | | +0.8 | | +1.5 (MAXIMUM) | |

KEY-DERESSING INSTRUCTION VALUE TABLE 81b

FIG. 20A

| | 1ST KEY-RELEASE LOAD P5 | | 2ND KEY-RELEASE LOAD P6 | | 3RD KEY-RELEASE LOAD P7 | | 4TH KEY-RELEASE LOAD P8 | |
|---|---|---|---|---|---|---|---|---|
| | END POSITION (mm) | INSTRUCTION VALUE (N) | END POSITION (mm) | INSTRUCTION VALUE (N) | END POSITION (mm) | INSTRUCTION VALUE (N) | END POSITION (mm) | INSTRUCTION VALUE (N) |
| | 0 | 0 | 3 | 0.5 | 5.2 | 0.3 | 1.0 | 1 |
| TOTAL VALUE OF LOADS (N) | 0 | | +0.3 | | +0.8 | | +1.5 (MAXIMUM) | |

KEY-RELEASING INSTRUCTION VALUE TABLE 82b

FIG. 20B

KEY-DEPRESSING REACTION FORCE PROFILE

KEY-RELEASING REACTION FORCE PROFILE

KEYBOARD APPARATUS

BACKGROUND

The present invention relates generally to keyboard apparatus provided in electronic keyboard instruments etc., and more particularly to a keyboard apparatus provided with force sense control and operation control functions for controlling an operational feeling and behavior of keys.

Keyboard units of natural keyboard instruments, such as acoustic pianos, which generate raw tones, are constructed to generate a tone by a hammer, pivoting in response to depression of a key, striking strings. In these keyboard units, an action mechanism, including a jack and a wippen, is provided between each key and a corresponding hammer. Such an action mechanism allows a characteristic reaction force to be applied from the key to a human player's finger. Thus, in the keyboard unit of a natural keyboard instrument, a key touch feeling characteristic of, or unique to, the keyboard instrument can be obtained.

Keyboard units of electronic keyboard instruments which generate electronic tones, on the other hand, include, among others, a spring and a mass member (pseudo hammer) for returning a depressed key to an initial position, and these keyboard units simulate a key touch feeling of a natural keyboard instrument through a reaction force provided by the spring and mass member. However, in the electronic keyboard instruments, which generate an electronic tone in response to depression of a key, there is provided no mechanism that actually strikes strings to generate an electronic tone and hence no complicated action mechanism as in the natural keyboard instruments. Consequently, the keyboard units of the electronic keyboard instruments cannot faithfully reproduce a key touch feeling provided through the action mechanism of the natural keyboard instruments, and thus, strictly speaking, the key touch feeling provided by the electronic keyboard instruments is different from that provided by the natural keyboard instruments.

Therefore, in the field of the electronic keyboard instruments, there have been proposed key drive and control devices (force sense control means) for changing a reaction force responsive to depression of a key with a view to achieving behavior of the key and key touch feeling approximate to that provided by the natural keyboard instruments. For example, a keyboard unit disclosed in Japanese Patent No. 2956180 (hereinafter referred to as "Patent Literature 1") includes an actuator (solenoid) for driving a key and a control means for controlling the actuator. Thus, the keyboard unit disclosed in Patent Literature 1 can simulate a performance feeling of a natural keyboard instrument by appropriately adjusting a key touch feeling.

Further, in a keyboard apparatus disclosed in Japanese Patent No. 3644136 (hereinafter referred to as "Patent Literature 2"), a key is normally biased in both of key-depressing and key-releasing directions by springs, acting in the key-depressing and key-releasing directions, respectively, so that the key is balanced at its rest position. The key is driven by a bidirectional actuator, so that the disclosed keyboard apparatus can achieve both force sense control on key depression and an automatic performance.

Furthermore, a keyboard apparatus disclosed in Japanese Patent Application Laid-open Publication No. 2005-195619 (hereinafter referred to as "Patent Literature 3") includes a mass member simulating a hammer member of an acoustic piano, and an inertial load of the mass member is imparted as a reaction force to operation of a corresponding key. The disclosed keyboard apparatus has a force sense control function in which other necessary viscous, elastic and frictional loads etc. are generated by an actuator (solenoid). The keyboard apparatus disclosed in Patent Literature 3 can create a key touch feeling approximate to that of an acoustic piano through cooperation between the mass member and the actuator.

With the keyboard unit disclosed in Patent Literature 1, where behavior of the key is controlled by the solenoid alone, it is difficult to replicate or reproduce a key touch feeling of an acoustic piano with high accuracy. Further, the keyboard apparatus disclosed in Patent Literature 2 includes the key-biasing springs as main elements for controlling behavior of the key. However, in the case where the behavior of the key is controlled by the springs, even if auxiliary force sense control of the key is performed through driving of the actuator, the keyboard apparatus disclosed in Patent Literature 2 cannot faithfully reproduce an inertial mass feeling characteristic of behavior of a key of a natural keyboard instrument, such as an acoustic piano. Particularly, whereas, in an acoustic piano, movement of a key has to be started at the start of depression of the key against a static load of a string-striking hammer, it is difficult for the keyboard apparatus disclosed in Patent Literature 2 to appropriately reproduce an operational feeling at the start of depression of a key on an acoustic piano. Further, even if the springs provided in the keyboard apparatus disclosed in Patent Literature 2 are replaced with a mass member that generates an inertial force in interlocked relation to movement of the key, a possibility of properly controlling a load applied from the mass member to the key through driving of the actuator would be limited because the mass member is provided separately from the actuator and because the mass member and the actuator differ in operating system. Therefore, it is necessary to further improve the keyboard apparatus, in order to create a key touch feeling more approximate to that of a natural keyboard instrument and permit an automatic performance with smooth movement of the keys.

Further, in the keyboard apparatus disclosed in Patent Literature 3, the actuator is provided in abutment with the key so as to directly impart a reaction force to the key. Further, although the mass member is also provided in abutment with the key so as to interlock with the movement of the key, it is not in abutment with the actuator; namely, the mass member and the actuator are provided separately from each other. Thus, the mass member and the actuator have different operating systems, so that there are limitations to appropriately controlling, through driving of the actuator, a load applied from the mass member to the key.

Further, in the known keyboard apparatuses including a key and a mass member operating in interlocked relation to the key, a driving force is transmitted between the key or mass member and another component part interposed therebetween in a driving force transmission path between the key and the mass member. Often, the key or mass member and the other component part perform mutually-different movement, such as pivoting movement and linear movement, in the force transmission path. In this case, in order to achieve a more natural operational feeling through force sense control, it is necessary to make an arrangement such that an appropriate frictional force is produced against relative movement between the key or mass member and the other component part while still securing interlocked movement between the key or mass member and the other component part. Because, a key touch feeling achieved by an action mechanism provided in an acoustic piano is created by differently-operating component parts, such as a spin roller, jack rod and hammer, moving relative to one another while involving appropriate friction thereamong, and it is required to reproduce the key touch feeling as faithfully as possible in the keyboard apparatus.

Furthermore, the keyboard apparatus disclosed in Patent Literatures 1 and 2 are constructed to simulate a key touch feeling of an acoustic piano by controlling the driving of the actuator that imparts a reaction force to the key. However, in natural keyboard instruments, such as an acoustic piano, including a complicated action mechanism, there is produced, during each of key depression and key release operation, a characteristic key touch feeling with an intensity of a reaction force varying from moment to moment in response to a changing key position (i.e., key depression amount), key velocity, etc. In order to faithfully reproduce such a key touch feeling of a natural keyboard instrument, there is a need to make further improvements in the driving control of the actuator performed in the conventionally-known keyboard apparatus.

SUMMARY OF THE INVENTION

In view of the foregoing, it is an object of the present invention to provide an improved keyboard apparatus which is simple in construction and yet can achieve creation of a key touch feeling extremely approximate to that of a natural keyboard instrument through force sense control and an automatic performance with smooth key movement.

It is another object of the present invention to provide an improved keyboard apparatus which can create a key touch feeling approximate to that of a natural keyboard instrument by producing an appropriate frictional force against relative movement between a key or mass member and another component part interposed therebetween while securing interlocked operation between the key or mass member and the other component part that perform mutually-different movement.

It is still another object of the present invention to provide an improved keyboard apparatus which can create a key touch feeling more approximate to that of a natural keyboard instrument through force sense control based on driving control of an actuator.

According to a first aspect according to the present invention, a keyboard apparatus includes a key, a mass member, a transmission member, an electromagnetic actuator, and a control section. The key is supported for pivoting movement about a key pivot point. The mass member imparts a reaction force to performance operation of the key in interlocked relation to movement of the key. The transmission member is in abutment with both of the key and the mass member to transmit a load from one of the key or the mass member to the other of the key or the mass member. The electromagnetic actuator includes a fixed coil and drives, via the coil, the transmission member toward at least one of the key or the mass member. The control section controls driving of the transmission member by the electromagnetic actuator.

With the mass member, which can constitute a main element for controlling behavior of the key, an inertial mass feeling characteristic of behavior of a key of a natural keyboard instrument, such as an acoustic piano, can be faithfully reproduced. The present keyboard apparatus can also appropriately reproduce an operational feeling at the start of depression of a key of an acoustic piano when movement of the key has to be started upon start of the depression of the key against a static load of a corresponding hammer. With the electromagnetic actuator, the keyboard apparatus can appropriately adjust a load (reaction force) to be imparted from the mass member to the key, so that a key touch feeling extremely approximate to that in a natural keyboard instrument, such as an acoustic piano, can be achieved.

Further, when imparting a key touch feeling to performance operation by a human player, the keyboard apparatus can provide a key touch feeling approximate to that in a natural keyboard instrument, such as an acoustic piano, only with the action of the mass member. Thus, the load control by the electromagnetic actuator can be relatively simple as compared to the load control performed in the force sense control by the conventionally-known keyboard apparatus. Even with such simplified load control, the present keyboard apparatus can appropriately reproduce an extremely good key touch feeling. Thus, using the simple construction and facilitated control, the present keyboard apparatus can faithfully reproduce a key touch feeling approximate to that in a natural keyboard instrument, such as an acoustic piano.

Further, by controlling the driving of the electromagnetic actuator, the present keyboard apparatus can adjust both the reaction force to be imparted from the mass member to depression operation of the key and the load acting from the mass member on the key. As a result, the present keyboard apparatus can achieve both force sense control on key depression operation by adjusting the load acting from the mass member on the key and an automatic performance involving automatic operation of the keys based on adjustment of forces acting on the keys in key depressing and releasing directions.

Furthermore, the transmission member to be driven by the electromagnetic actuator is located between the key and the mass member, and a driving force generated by the electromagnetic actuator is imparted to at least one of the key or the mass member. Thus, a same operating system can be shared between the mass member acting on the key and the electromagnetic actuator, so that the load acting from the mass member on the key can be appropriately controlled by the electromagnetic actuator and the force sense control and driving control can be performed appropriately on the key.

The mass member can include a mass section and an arm section that supports the mass section for angular movement in a region over the key. The transmission member can be provided in abutment with a portion of the key located on an opposite side from a key depression section of the key with respect to (i.e., as viewed from) the key pivot point and in abutment with the arm section of the mass member. Alternatively, the mass section and the arm section can supports the mass section for angular movement in a region under the key, and the transmission member can be provided in abutment with a portion of the key located on the same side as a key depression section of the key with respect to the key pivot point and in abutment with the arm section of the mass member. Such a construction is equivalent to a construction where a wippen assembly disposed between a key and a hammer in an action mechanism of an acoustic piano is replaced with the transmission member and electromagnetic actuator of the invention. Thus, by the transmission member and electromagnetic actuator performing the function of the wippen assembly, the present keyboard apparatus can achieve a key touch feeling extremely approximate to that of an acoustic piano with minimum necessary structural arrangements and control. In addition, the present keyboard apparatus can perform an automatic performance involving automatic operation of the keys.

The keyboard apparatus can further include an operation detection section that detects operation of at least one of the transmission member, the key, or the mass member. The control section controls, on the basis of a detection result of the operation detection section, a driving force to be generated by the electromagnetic actuator. Because force sense control can be performed on the key on the basis of actual movement or operation of the transmission member, key and mass member, the present keyboard apparatus can achieve a good operational feeling of the key.

The control section can include a force sense imparting table containing a pattern of driving forces to be generated by the electromagnetic actuator in response to depression of the key and a pattern of driving forces to be generated by the electromagnetic actuator in response to release of the key. The control section can reference the force sense imparting table in response to depression operation or release operation of the key to control the electromagnetic actuator in accordance with the pattern provided by the force sense imparting table.

The present keyboard apparatus can create a key touch feeling extremely approximate to that in a natural keyboard instrument and permits an automatic performance with automatic operation of the keys.

According to a second aspect according to the present invention, the keyboard apparatus includes the key supported for pivoting movement about a key pivot point, the mass member that imparts a reaction force to performance operation of the key in interlocked relation to movement of the key, the transmission member provided in abutment with both of the key and the mass member to transmit a load from one of the key or the mass member to the other of the key or the mass member, and a coupling mechanism that detachably couples the mass member and the transmission. Specifically, the coupling mechanism can comprise a magnet fixed to one of the mass member or the transmission member and an attraction member attractable to the magnet fixed to the other of the mass member or the transmission member. The attraction member can be a metal member attractable to the magnet, another magnet, etc.

With the mass member that imparts a reaction force to performance operation of the key in interlocked relation to movement of the key, the present keyboard apparatus can faithfully reproduce an inertial mass feeling characteristic of behavior of a key of a natural keyboard instrument, such as an acoustic piano. The present keyboard apparatus can also appropriately reproduce an operational feeling at the start of depression of a key of an acoustic piano when movement of the key has to be started upon start of depression of the key against a static load of a corresponding hammer.

Further, in the keyboard apparatus, where the mutually-abutting portions of the mass member and the transmission member are joined with each other by an attracting force of the magnet, the magnet and the attraction member move relative to each other. Thus, the mass member and the transmission member are allowed to move relative to each other relatively freely while being kept in contact with each other. Even where the mass member and the transmission member perform different movement, such as linear movement and pivoting movement, the mass member and the transmission member can reliably operate in interlocked relation to each other. Further, with the abutting portions of the mass member and the transmission member joined with each other by an attracting force of the magnet, the present keyboard apparatus can achieve, with a simple mechanism, a construction where the mass member and the transmission member are allowed to move relative to each other while being kept in contact with each other as the key and mass member operate.

In the mutually-abutting portions of the mass member and the transmission member, a certain frictional force is produced, due to the magnetic force, between the magnet and the attraction member moving relative to each other. In this way, the keyboard apparatus can appropriately reproduce a particular operational feeling of a key arising from friction produced within an action mechanism of an acoustic piano. As a result, the keyboard apparatus can also achieve an operational feeling of a key when a jack rod pushes up a spin roller and slides to escape in an action mechanism of an acoustic piano and an operational feeling ("so-called pseudo backcheck operation" feeling) approximate to rebound checking operation (i.e., "backcheck operation") after a hammer abuts a stopper member in an action mechanism of an acoustic piano. Furthermore, with the mass member and the transmission member joined to each other through the magnetic attracting force, force transmission between the mass member and the transmission member can be effected steadily and reliably, as compared to a case where the mass member and the transmission member are merely held in abutment with each other with no attracting force therebetween. As a result, the keyboard apparatus can more faithfully reproduce an operational feeling of an acoustic piano. Further, with the mass member and the transmission member magnetically joined to each, the mass member can quickly return to its initial position by being taken by the key, as the key returns to its initial position. Thus, a state where next tone generation by operation of the key is enabled can be achieved quickly, which permits performance of quick passages.

One of the magnet or the attraction member can angularly move in response to movement of the mass member or the transmission member while the other of the magnet or the attraction member can linearly move in response to movement of the transmission member or the mass member. The magnet and the attraction member can slide along each other's surfaces in response to the movement of the mass member and the transmission member. Thus, in a region where the linearly-moving magnet or attraction member and the angularly-moving attraction member or magnet are joined to each other, the mass member and the transmission member are allowed to slidingly move relative to each other relatively freely while being kept in contact with each other. Consequently, the keyboard apparatus permits relative movement between the mass member and the transmission member involving an appropriate frictional force (static and dynamic frictional force) therebetween while securing interlocked relationship between the mass member and the transmission member, improving behavior and operational feeling of the key.

At least one of a surface of the magnet abutting against the attraction member or a surface of the attraction member abutting against the magnet can be formed in a curved shape. Consequently, the keyboard apparatus permits relative sliding movement between the mass member and the transmission member involving an appropriate frictional force, improving behavior and operational feeling of the key.

The keyboard apparatus can include the electromagnetic actuator that imparts a driving force generated thereby to the key and the mass member, and the control section that controls generation of the driving force by the electromagnetic actuator. The electromagnetic actuator can include a driving source that drives the transmission member toward at least one of the key or the mass member. Because a load (reaction force) to be imparted from the mass member to the key can be appropriately controlled by the electromagnetic actuator, the present keyboard apparatus can readily achieve a key touch feeling extremely approximate to that in a natural keyboard instrument, such as an acoustic piano.

The keyboard apparatus according to the second aspect also can create a key touch feeling approximate to that in a natural keyboard instrument by producing an appropriate frictional force between the key or mass member and another component part interposed therebetween and performing different movement from the key or mass member while securing interlocking operation between the key or mass member and the other component part.

According to a third aspect according to the present invention, the keyboard apparatus includes the key supported for pivoting movement about a key pivot point, the mass member that imparts a reaction force to depression or release operation of the key in interlocked relation to movement of the key, a bi-directionally driven actuator that imparts a driving force to the key to control a force sense to be imparted to the depression or release operation of the key, a control section that controls the driving force to be generated by the actuator, and a key operation information acquisition section that acquires information pertaining to a position and movement of the key, in a key depressing or releasing direction. The control section determines, on the basis of the information pertaining to the position and movement of the key acquired by the key operation information acquisition section, an instruction value of the driving force to be imparted to the key. The actuator selectively generates, as a driving force corresponding to the instruction value determined by the control section, one of (a) a driving force acting to increase a reaction force imparted from the mass member to the depression or release operation of the key, or (b) a driving force acting to decrease the reaction force imparted from the mass member to the depression operation of the key.

With the force sense control on the key performed through driving of the actuator, the present keyboard apparatus can appropriately adjust in real time, the key touch feeling that occurs in response to performance operation. As a result, the keyboard apparatus can faithfully reproduce a key touch feeling that occurs in response to performance operation in a natural keyboard instrument, such as an acoustic piano, including a complicated action mechanism.

The present keyboard apparatus is designed to simulate a key touch feeling of a natural keyboard instrument by the electromagnetic actuator generating an assisting driving force, a reaction force applied to key depression operation based only on the mechanical structure of the key and the mass member (i.e., reaction force when no driving force is generated by the electromagnetic actuator) would considerably differ from a reaction force generated in a natural keyboard instrument, such as an acoustic piano. Consequently, at an initial stage of depression of the key, from a time when the key starts moving in response the depression operation to a time when a predetermined key depression amount is reached, the actuator generates, as the driving force corresponding to the instruction value, the driving force acting to decrease the reaction force imparted from the mass member to the depression operation of the key.

The inertial load applied from the mechanical structure of the mass member to the key would take a great value as compared to an inertial load applied to a depressed key in the natural keyboard instrument. There has been no keyboard apparatus with an actuator that generates a driving force acting to decrease a reaction force imparted from the mass member to the key. This makes it impossible to appropriately correct a key touch feeling that occurs at an initial stage of depression of the key and that tends to be heavier than that in a natural keyboard instrument.

To achieve appropriate correction of a key touch feeling, it may be conceivable to make the mass member considerably light in weight and make an arrangement for covering most of the driving force, acting in the direction to increase the reaction force of the mass member, using the electromagnetic actuator. But to impart a driving force to maximize the reaction force of the mass member, it is necessary for the electromagnetic actuator to produce extremely great output, requiring excessively great electric power needed to drive the electromagnetic actuator. Consequently, electric power usable for tone control in the keyboard apparatus can run short, a tone generated via the keyboard apparatus can become undesirably distorted, and necessary control in the keyboard apparatus can undesirably become insufficient. Further, because the width of the key and an available installation space for the electromagnetic actuator are limited, there exist limitations to increasing the output of the electromagnetic actuator.

The present keyboard apparatus resolves the problem using the bi-directionally driven electromagnetic actuator, which not only imparts a driving force acting to increase the reaction force imparted from the mass member to operation of the key but also imparts a driving force acting to decrease the reaction force imparted from the mass member to operation of the key, and thus can effectively correct a difference in key touch feeling at the initial stage of depression of the key between the inventive keyboard apparatus and a natural keyboard instrument. In addition, the present keyboard apparatus can achieve a superior key-driving efficiency.

The present keyboard apparatus can be arranged so that, at an initial stage of depression of the key from a time when the key starts moving in response the depression operation to a time when a predetermined key depression amount is reached, the actuator generates the driving force acting to decrease the reaction force imparted from the mass member to the depression operation of the key. The keyboard apparatus according to the third aspect can create a key touch feeling more approximate to that in a natural keyboard instrument, through force sense control performed on the key based on driving control of the actuator.

The following will describe embodiments of the present disclosure, but it should be appreciated that the present invention is not limited to the described embodiments and various modifications of the present invention are possible without departing from the basic principles.

BRIEF DESCRIPTION OF THE DRAWINGS

For better understanding of the object and other features of the present invention, its preferred embodiments will be described hereinbelow in greater detail with reference to the accompanying drawings.

FIGS. 4A and 4B are views explanatory of the key and a mass member, of which FIG. 4A shows a state where the key is in a non-depressed position while FIG. 4B shows a state where the key is in a depressed position.

FIGS. 12A and 12B are views explanatory of behavior of the key and mass member, of which FIG. 12A shows a state where the key is in the non-depressed position while FIG. 12B shows a state where the key is in the depressed position.

FIGS. 20A and 20B are diagrams showing specific contents of the force sense imparting table, of which FIG. 20A shows a key-depressing instruction value table while FIG. 20B shows a key-releasing instruction value table.

FIGS. 21A and 21B are graphs showing reaction force profiles based on the instruction value tables, of which FIG. 21A shows a key-depressing reaction force profile while FIG. 21B shows a key-releasing reaction force profile.

FIGS. 24A and 24B are graphs showing relationship between a displacement (depression amount) of the key and a reaction force applied from the key to a human player's finger depressing the key, of which FIG. 24A shows a distribution of reaction forces at the time of depression of the key while FIG. 24B shows a distribution of reaction forces at the time of release of the key when the key.

DETAILED DESCRIPTION

Figure 1:
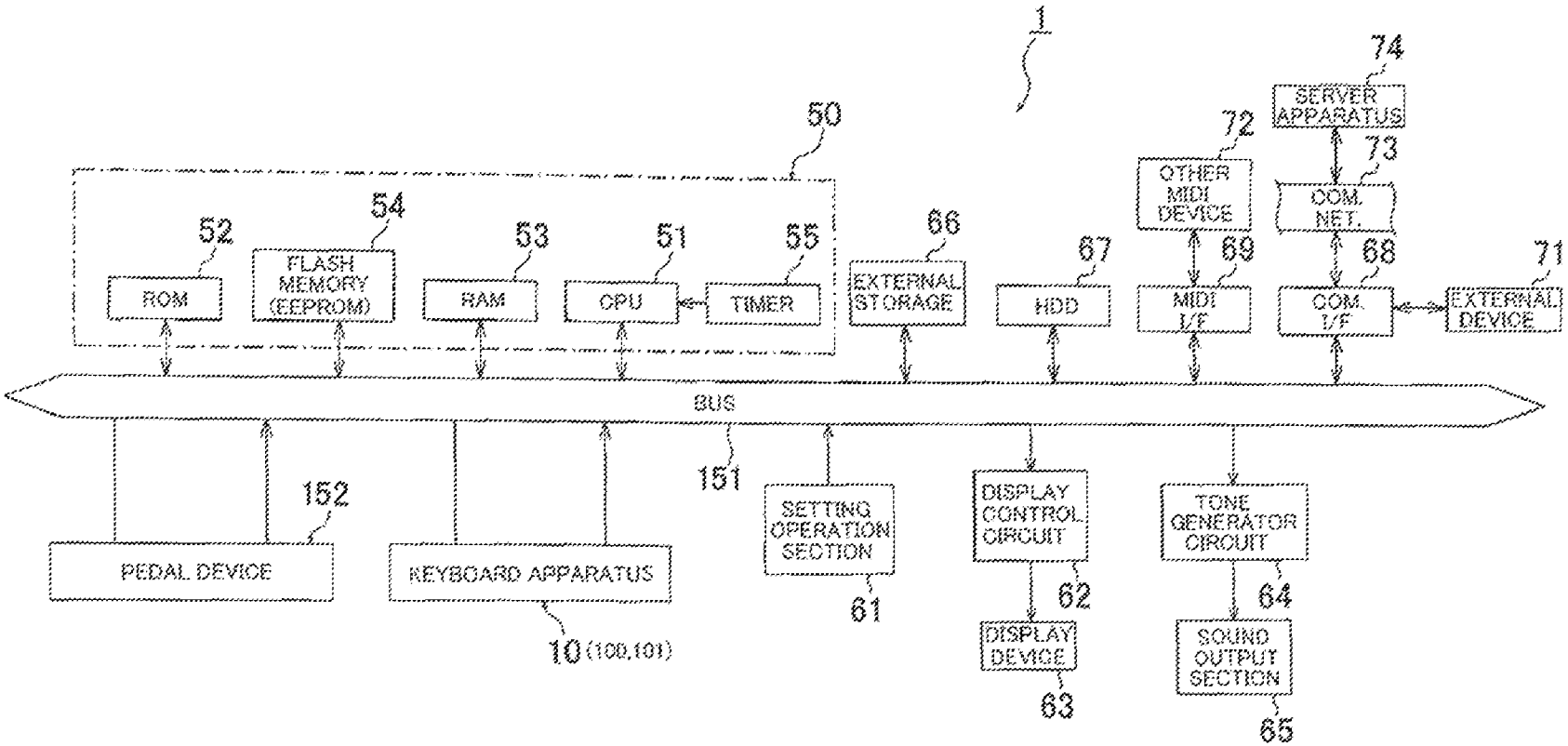
FIG. 1 is a block diagram showing an example general setup of an electronic keyboard instrument provided with an embodiment of a keyboard apparatus of the present invention.

FIG. 1 is an overview block diagram showing an example general setup of an electronic keyboard instrument provided with an embodiment of a keyboard apparatus of the present invention. The electronic keyboard instrument 1 shown in FIG. 1 includes the keyboard apparatus 10 (or 100 or 101) having a plurality of keys 20, a pedal device 152, and a main control section 50 for controlling the entire electronic keyboard instrument 1 including the keyboard apparatus 10 and pedal device 152. Various components, such as the keyboard apparatus 10 (or 100 or 101), pedal device 152 and main control section 50, are interconnected via a bus 151.

First Embodiment

First, first to third embodiments according to a first aspect of the present invention will be described with reference to FIGS. 2 to 9.

Figure 2:
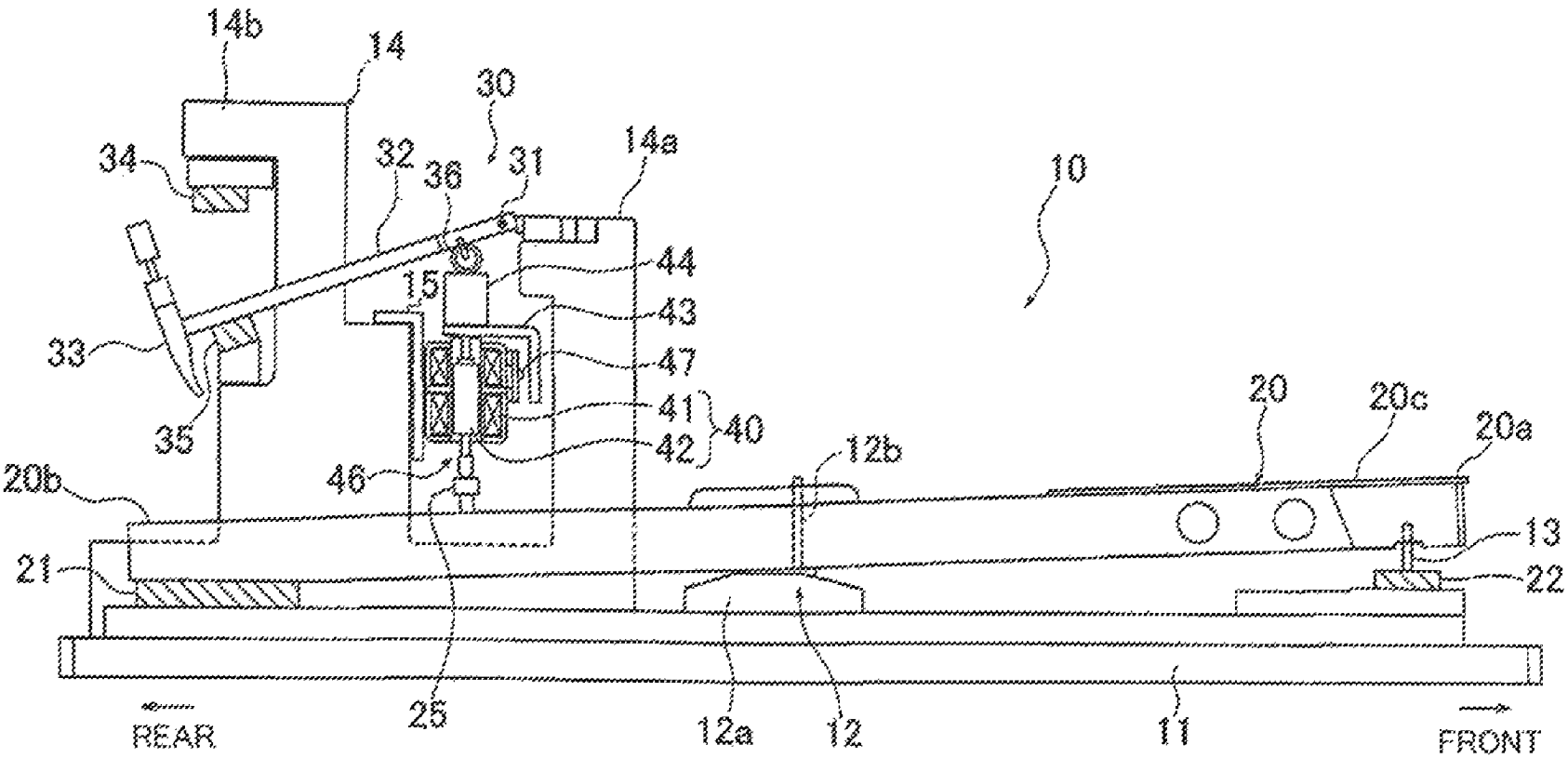
FIG. 2 is a schematic side view of a first embodiment of the keyboard apparatus of the present invention, which particularly shows one of the keys and other component parts around the key.
Figure 3:
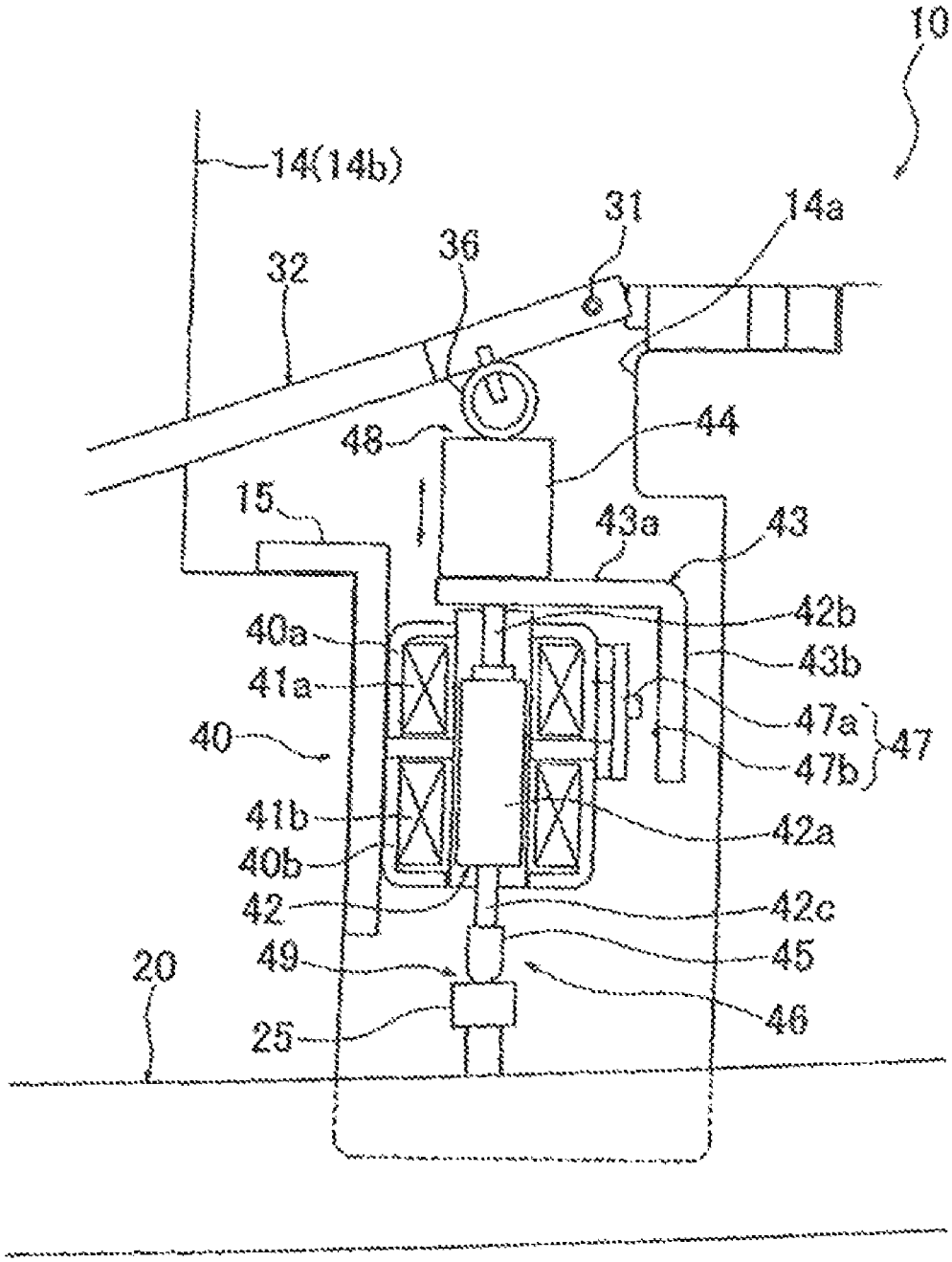
FIG. 3 is a fragmentary enlarged side view showing detailed constructions of an electromagnetic actuator and other component parts around the actuator.
Figure 4A:
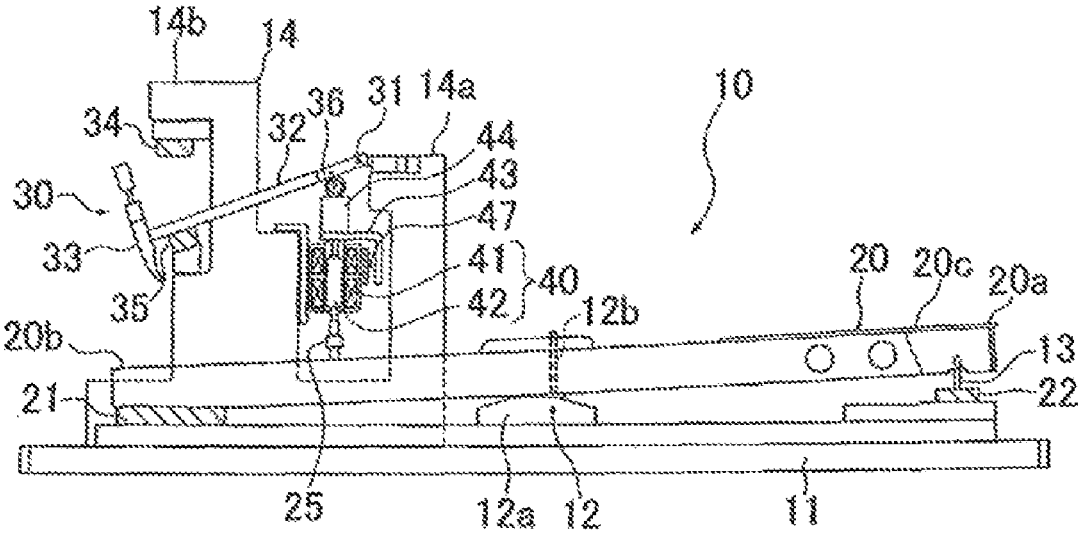
Figure 4B:
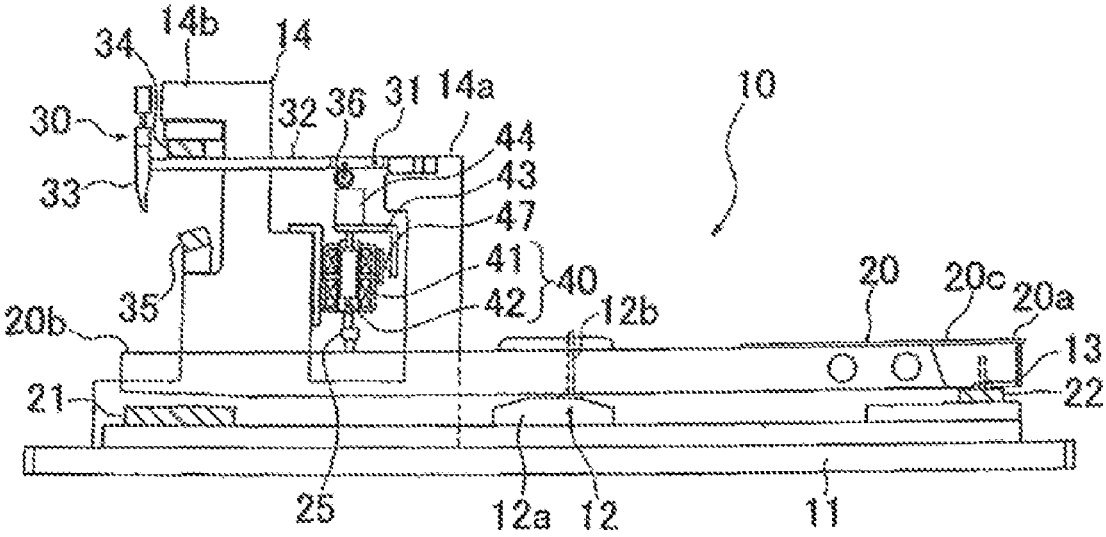

FIG. 2 is a schematic side view of the first embodiment of the keyboard apparatus 10, which particularly shows one of the keys 20 and other component parts around the key 20. FIG. 3 is a fragmentary enlarged side view showing detailed constructions of a later-described electromagnetic actuator (driving force impartment section) 40 and other component parts around the actuator 40. Further, FIG. 4 is a view explanatory of behavior of the keyboard apparatus 10, of which FIG. 4A shows a state where the key 20 is in a non-depressed position while FIG. 4B shows a state in which the key 20 is in a depressed position. The keyboard apparatus 10 includes a frame 11 of a flat plate shape that forms part of the electronic keyboard instrument 1, the keys 20 and mass members (i.e., pseudo hammers) 30 each pivotably supported on the frame 11, and the electromagnetic actuators 40 each provided between the corresponding key and mass member 30. Hereinafter, one of opposite sides of the electronic keyboard instrument 1 (corresponding to opposite longitudinal ends of the individual keys 20) which is located closer to a human player will be referred to as "front", while the other of the opposite sides of the electronic keyboard instrument 1 which is located opposite from the one side will be referred to as "rear". Note that FIG. 2 shows only one of a plurality of the keys 20 provided in parallel to one another in the keyboard apparatus 10 and other component parts around the one key 20. Further, although the key 20 shown in FIG. 2 is a white key, the following description also applies to a black key 20. Further, although not particularly shown, the keyboard apparatus 10 further includes a switch contact mechanism for converting motion or movement of the key 20 into an electric output so that a tone corresponding to the movement of the key 20 can be generated.

The key 20 is supported at its longitudinal middle position (i.e., middle position in a front-rear direction of the key 20) for vertical pivoting movement about a key fulcrum or key pivot point 12 of the frame 11. More specifically, the key 20 is supported on a support pin 12*b* that projects upward from a balance rail 12*a* extending horizontally across the keys 20 (i.e. in a key-arranged direction) on the frame 11. The key 20 is vertically pivotable, in response to human player's depression operation on a key depression section 20*c*, about the support pin 12*b* in such a manner that its front end region 20*a* and rear end region 20*b* can angularly move about the key pivot point 12 in an up-down direction. Further, a front pin 13 is provided under the front end region 20*a* of the key 20 to project upward from the frame 11 and has its upper end inserted in an underside of a front end region 20*a* of the key 20. Thus, the front pin 13 functions to prevent lateral swing of the front end region 20*a* of the vertically pivoting key 20.

An upper key's pivoting movement limiting stopper (hereinafter "upper key limit stopper") 21 is provided under the rear end region 20*b* of the key 20, while a lower key's pivoting movement limiting stopper (hereinafter "lower key limit stopper") 22 is provided under the front end region 20*a* of the key 20. Each of the upper key limit stopper 21 and lower key limit stopper 22 includes a shock absorbing material, such as felt, fixedly attached to the upper surface of the frame 11. The upper key limit stopper 21 abuts against the lower surface of the rear end region 20*b* of the key 20 when the key 20 is in the non-depressed position shown in FIG. 4A, to thereby restrict pivoting movement, in a counterclockwise direction of FIG. 2, of the key 20 in the non-depressed position. Similarly, the lower key limit stopper 22 abuts against the lower surface of the front end region 20*a* of the key 20 when the key 20 is in the depressed position shown in FIG. 4B, to thereby restrict pivoting movement, in a clockwise direction of FIG. 2, of the key 20 in the depressed position.

Further, a post-shaped support section 14 for supporting the mass member 30 is provided on a portion of the frame 11 located rearwardly of the key pivot point 12. More specifically, one such support section 14 is provided on the frame 11 per a predetermined plurality of the keys and projects upwardly from between adjacent ones of the keys 20. The support section 14 includes front and rear walls 14*a* and 14*b* provided at a predetermined horizontal interval from each other. The front and rear walls 14*a* and 14*b* each project vertically upward above the key 20.

A plurality of the mass members 30 supported by the support section 14 are provided in one-to-one corresponding relation to the keys 20 and each located immediately over the corresponding key 20 and rearwardly of the corresponding key pivot point 12. The mass member 30 includes a shank section (or arm section) 32 of a linear rod shape extending rearwardly from a mass member fulcrum or pivot point 31 that is provided at the upper end of the front wall 14*a* of the support section 14, and a mass section (i.e., weight) 33 having a predetermined mass and provided at the distal end of the shank section 32. The shank section 32 is supported for vertical pivoting movement about the pivot point 31; more specifically, the shank section 32 is pivotable in a vertical plane lying orthogonal to the length of the key 20. The mass section 33 is formed in a rod shape extending along a pivoting direction of the shank section 32. Namely, the mass member 30 is pivotable about the mass member pivot point 31 in such a manner that the mass section 33 angularly moves in the up-down direction in a region over the rear end region 20*b* of the key 20 with the shank section 32 functioning as a pivot arm.

On the rear wall 14*b* of the support section 14 are provided an upper mass member's pivoting movement limiting stopper (hereinafter "upper mass member limit stopper") 34 for limiting pivoting movement, in the clockwise direction of FIG. 2, of the mass member 30 and a lower mass member's pivoting movement limiting stopper (hereinafter "lower mass member limit stopper") 35 for limiting pivoting movement, in the counterclockwise direction of FIG. 2, of the mass member 30. The lower mass member limit stopper 35 abuts against the shank section 32 of the mass member 30 angularly moved to a lower limit position, while the upper mass member limit stopper 34 abuts against the shank section 32 of the mass member 30 angularly moved to an upper limit position. With these lower mass member limit stopper 35 and upper mass member limit stopper 34, the mass member 30 is pivotable between a lower limit position where the shank section 32 extends rearwardly and downwardly from the mass member pivot point 31 as shown in FIG. 4A and an upper limit position where the shank section 32 extends rearwardly and substantially horizontally from the mass member pivot point 31 as shown in FIG. 4B. The mass member 30 moves in interlocked relation to movement of the key 20 via a later-described transmission member 46, so that it imparts a reaction force to performance operation of the key 20 in conjunction with the electromagnetic actuator 40.

The electromagnetic actuator 40 for imparting a predetermined driving force to the key 20 and mass member 30 is provided between an upper surface portion of the key 20 located rearwardly of the key pivot point 12 and the shank section 32 of the mass member 30. In the instant embodiment, the electromagnetic actuator 40 is a bi-directionally-driven actuator which includes a fixed coil section 41 comprising two fixed solenoid coils, i.e. projecting coil 41*a* and retracting coil 41*b*, disposed in vertical coaxial alignment with each other, and a single plunger 42 vertically slidably inserted within the projecting coil 41*a* and retracting coil 41*b*. Further, yokes 40*a* and 40*b* are provided around, i.e. surround, the outer peripheries of the projecting coil 41*a* and retracting coil 41*b*, respectively.

Each of the above-mentioned yokes 40*a* and 40*b* is fixed at its rear surface to the front surface of the rear wall 14*b* of the support section 14 via a flat plate 15. Thus, the projecting coil 41*a* and retracting coil 41*b* are fixed to the support section 14 and frame 11 that are fixed component parts. The plunger 42 includes a body portion 42*a* in the form of a column-shaped ferromagnetic substance which is reciprocatively slidable in the up-down direction inside the projecting coil 41*a* and retracting coil 41*b*, a first rod 42*b* connected to the upper end of the body portion 42*a*, and a second rod 42*c* connected to the lower end of the body portion 42*a*. The body portion 42*a*, first rod 42*b* and second rod 42*c* are disposed in vertical axial alignment with one another. A flat plate member 43 for mounting thereon a later-described position sensor (operation detection section) 47 is fixed to the upper end of the first rod 42*b*. The plate member 43, which is a relatively light-weight member, includes a horizontal body portion 43*a* fixed to the upper end of the first rod 42*b* and a front wall portion 43*b* extending from the front end of the horizontal body portion 43*a* vertically downward; thus, the plate member 43 has a substantially "L" sectional shape. A support member 44 having a horizontal upper surface is fixed to the upper surface of the horizontal body portion 43*a*. A cylindrical roller 36 is mounted on the lower surface of the shank section 32 opposed to the support member 44. The cylindrical roller 36 has a horizontal axis extending in the key-arranged direction and is placed at its lower surface portion on the upper surface of the support member 44. Further, a cap-shaped cover member 45, having shock absorbing and sliding functions, is fixed to the lower end of the second rod 42*c* and placed at its lower end on a screw 25 that is opposed to the cover member 45.

The above-mentioned plunger 42 (including the body portion 42*a*, first rod 42*b* and second rod 42*c*), plate member 43 and support member 44 together constitute the transmission member 46 for transmitting a load (i.e., load by a mass or inertial load due to pivoting movement) from one of the key 20 and mass member 30 to the other of the key 20 and mass member 30. The transmission member 46 is held sandwiched between the mass member 30 and the key 20 by a load due to the self-weight of the mass member 30.

The electromagnetic actuator 40 can drive the transmission member 46 (i.e., plunger 42) in two directions by the projecting coil 41*a* and retracting coil 41*b* being supplied with driving currents. Namely, as the retracting coil 41*b* is supplied with the driving current, the transmission member 46 moves downward; thus, a downward load is imparted from the transmission member 46 to a portion of the key 20 located rearwardly of the key pivot point 12, so that a load acting on the key 20 in a key-releasing direction increases. On the other hand, as the projecting coil 41*a* is supplied with the driving current, the plunger 42 moves up; thus, the load acting downward on the portion of the key 20 located rearwardly of the key pivot point 12 decreases, so that the load acting on the key 20 in the key-releasing direction decreases.

Namely, the key 20 is normally biased in the key-releasing direction by the load (i.e., load by the mass of the mass member 30) applied thereto via the transmission member 46.

The key 20 is caused to pivot in a key depressing direction as the load from the mass member 30 is reduced by the driving force of the electromagnetic actuator 40. In this case, when the key 20 is not being depressed, the load applied, in the key releasing direction, from the mass member 30 is greater than a biasing force, in the key depressing direction, applied by the self-weight of the key 20, and thus, the key 20 is held in a key-released position with the biasing force in the key depressing direction cancelled out. Then, as the load from the mass member 30 is reduced by the driving force of the electromagnetic actuator 40, the biasing force, in the key depressing direction, by the self-weight of the key 20 gradually becomes greater than the load, in the key releasing direction, from the mass member 30, so that the key 20 pivots in the key depressing direction.

While the key 20 and mass member 30 pivot about the respective pivot points 12 and 31, the transmission member 46 (plunger 42) linearly moves in its axial direction inside the projecting coil 41*a* and retracting coil 41*b*. Thus, as the key 20, mass member 30 and transmission member 46 move integrally with one another, the upper end of the vertically-linearly moving transmission member 46 slides on and along the outer peripheral surface of the roller 36 angularly moving in response to the vertical pivoting movement of the mass member 30, in a first abutment area 48 where the upper end of the transmission member 46 (i.e., upper surface of the support member 44) and the roller 36 of the mass member 30 is held in abutment with each other. Similarly, in a second abutment area 49 where the lower end of the transmission member 46 is held in abutment with the screw 25 of the key 20, the lower end of the linearly-vertically moving transmission member 46 slides on and along the upper surface of the screw 25 that angularly moves in response to the pivoting movement of the key 20.

Further, in the instant embodiment of the keyboard apparatus 10, the transmission member 46 may be held in abutment with the key 20 or mass member 30 in such a manner that it can disengage from the key 20 or mass member 30 depending on the operation of the key 20 or mass member 30, for the following reason. Namely, the transmission member 46 normally moves integrally with the key 20 and mass member 30 with its opposite ends (i.e., upper and lower ends) held in abutment with the key 20 and mass member 30. But, when the key 20 has been depressed rapidly with a great depressing force or depressed or released at an extremely high speed, and if acceleration produced in the transmission member 46 and acceleration produced in the key 20 or mass member 30 differ from each other, the transmission member 46 may sometimes instantaneously disengage from the key 20 or mass member 30. However, the transmission member 46 need not necessarily be disengageable from the key 20 or mass member 30, and the transmission member 46 may be non-disengageably coupled (e.g. via a link joint) to the key 20 or mass member 30, as long as a driving force can be transmitted from the transmission member 46 to the key 20 or mass member 30.

Further, in the keyboard apparatus 10, the position sensor (operation detection section) 47 is provided for detecting a position of the transmission member 46 (plunger 42). The position sensor 47, as shown in FIG. 3, includes a light receiving section 47*a* provided on the front surfaces of the yokes 40*a* and 40*b*, and a reflection surface 47*b* provided on a position, opposed to the light receiving section 47*a*, of the front wall portion 43*b* of the plate member 43. Namely, the position sensor 47 is a reflection type sensor constructed so that the light receiving section 47*a* receives reflected light from the reflection surface 47*b*. The reflection surface 47*b* is constructed in such a manner that reflected light amounts from different vertical positions of the reflection surface 47*b* vary continuously. Thus, a position of the transmission member 46 can be identified on the basis of an output signal from the light receiving section 47*a*.

As long as the position sensor 47 can detect a position of the transmission member 46 (plunger 42), it may be of any other type than the above-mentioned reflection type, such as another optical type or non-optical type. Alternatively, the position sensor 47 may be replaced with a position detecting switch or the like. Further, whereas the instant embodiment has been described above as including the position sensor 47 as one example of the operation detection section for detecting operation of the transmission member 46, the embodiment may include, in addition to the position sensor 47, a velocity sensor or an acceleration sensor for detecting an operating speed or velocity or acceleration of the transmission member 46, or a combination thereof.

Further, the instant embodiment of the keyboard apparatus 10 is constructed to detect operation (displacement, velocity, etc.) of the transmission member 46 and perform driving control on the electromagnetic actuator 40 on the basis of the detection of the operation of the transmission member 46. In addition, the instant embodiment of the keyboard apparatus 10 may include an operation detection section for detecting operation (position, velocity, acceleration, etc.) of the key 20 or mass member 30 and perform driving control on the electromagnetic actuator 40 on the basis of the detection of the operation of the key 20 or mass member 30. In an alternative, the instant embodiment of the keyboard apparatus 10 may include one or more operation detection sections for detecting operation of at least one of the transmission member 46, key 20 and mass member 30, so that any of the operation detection sections can be used for driving control on the electromagnetic actuator 40 while the remaining of the operation detection sections can be used for tone generation control on an electronic tone generator. Of course, one operation detection section may be used for both the driving control on the electromagnetic actuator 40 and the tone generation control on the electronic tone generator.

As set forth above, the instant embodiment of the keyboard apparatus 10 includes the mass member 30 provided for pivoting movement in the region over the key 20, and the electromagnetic actuator 40 and transmission member 46 provided between the key 20 and the mass member 30 for imparting a generated driving force to the key 20 and mass member 30. The electromagnetic actuator 40 and transmission member 46 are disposed between a portion of the key 20 located on an opposite side from the key depression section 20*c* with respect to (i.e., as viewed from) the key pivot point 12. Further, the electromagnetic actuator 40 is a single device that can be actuated to drive the transmission member 46 in two directions, i.e. a direction toward the mass member 30 and a direction toward the key 20.

The following describe the main control section 50 shown in FIG. 1. The main control section 50 includes a CPU 51, a ROM 52, a RAM 53 and a flash memory (EEPROM) 54. A timer 55 is connected to the CPU 51. The CPU 51 controls the entire electronic keyboard instrument 1 including the keyboard apparatus 10. The ROM 52 and flash memory 54 have stored therein not only control programs to be executed by the CPU 51 and various table data, but also a later-described force sense imparting table 80 and automatic performance data 85. The RAM 53 temporarily stores various information, such as performance data and text data, various flags, buffer data and results of arithmetic operations. The timer 55 counts various times, such as times to signal interrupt timing for timer interrupt processes.

The instant embodiment of the keyboard apparatus 10 further includes a setting operation section 61, a display device 63, a sound output section 65, an external storage device 66, an HDD 67, a communication interface 68, a MIDI interface 69, etc. An external device 71 is connectable to the communication interface 68, and a MIDI device 72 is connectable to the MIDI interface 69. Further, the communication interface 68 permits communication with an external server apparatus 74 via a communication network 73, such as the Internet. The setting operation section 61 includes various switches (not shown) operable by the human player to enter setting operation information, and a signal generated in response to operation of any of the switches is supplied to the CPU 51. The external storage device 66 and HDD 67 are provided for storing various application programs, including the above-mentioned control programs, and various music piece data. The display device 63 is connected to the bus 51 via a display control circuit 62, and the sound output section 65 is connected to the bus 51 via a tone generator circuit 64.

Figure 5:
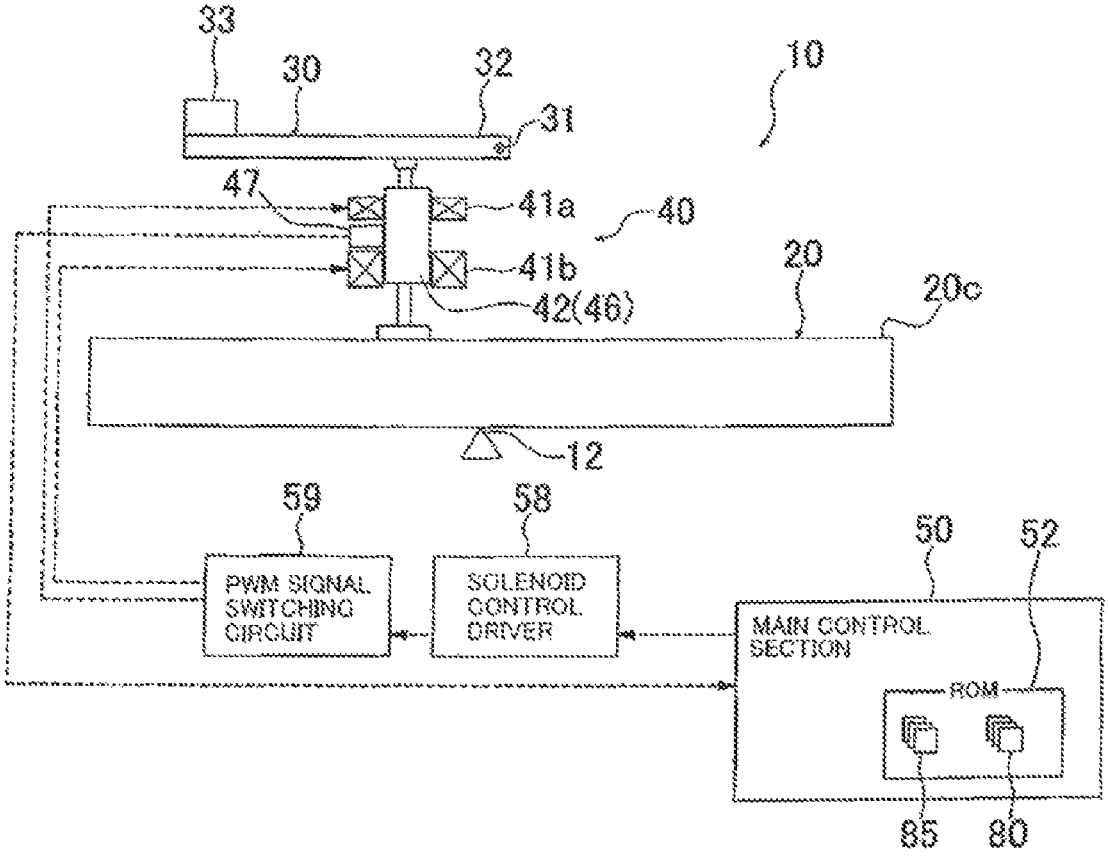
FIG. 5 is a block diagram showing a general construction of the keyboard apparatus including a drive control circuit.

FIG. 5 is a block diagram showing a general construction of the keyboard apparatus 10 including a driving control circuit for controlling driving of the key 20. As shown in FIG. 5, the driving control circuit of the keyboard apparatus 10 includes the main control section 50, and a control driver 58 and PWM switching circuit 59 for outputting a driving PWM (Pulse Width Modulation) signal to the projecting coil 41*a* or retracting coil 41*b* of the actuator 40 in accordance with an instruction given from the control section 50. The main control section 50, which is constructed in the manner as shown in FIG. 1, includes the ROM 52 having stored therein the force sense imparting table 80 and automatic performance data 85. Position information of the plunger 42 detected by from the position sensor 47 is supplied to the control driver 58 and PWM switching circuit 59. Then, the control driver 58 and PWM switching circuit 59 supply a driving current to the projecting coil 41*a* or retracting coil 41*b* of the actuator 40 on the basis of the control signal given from the control section 50.

Figure 6:
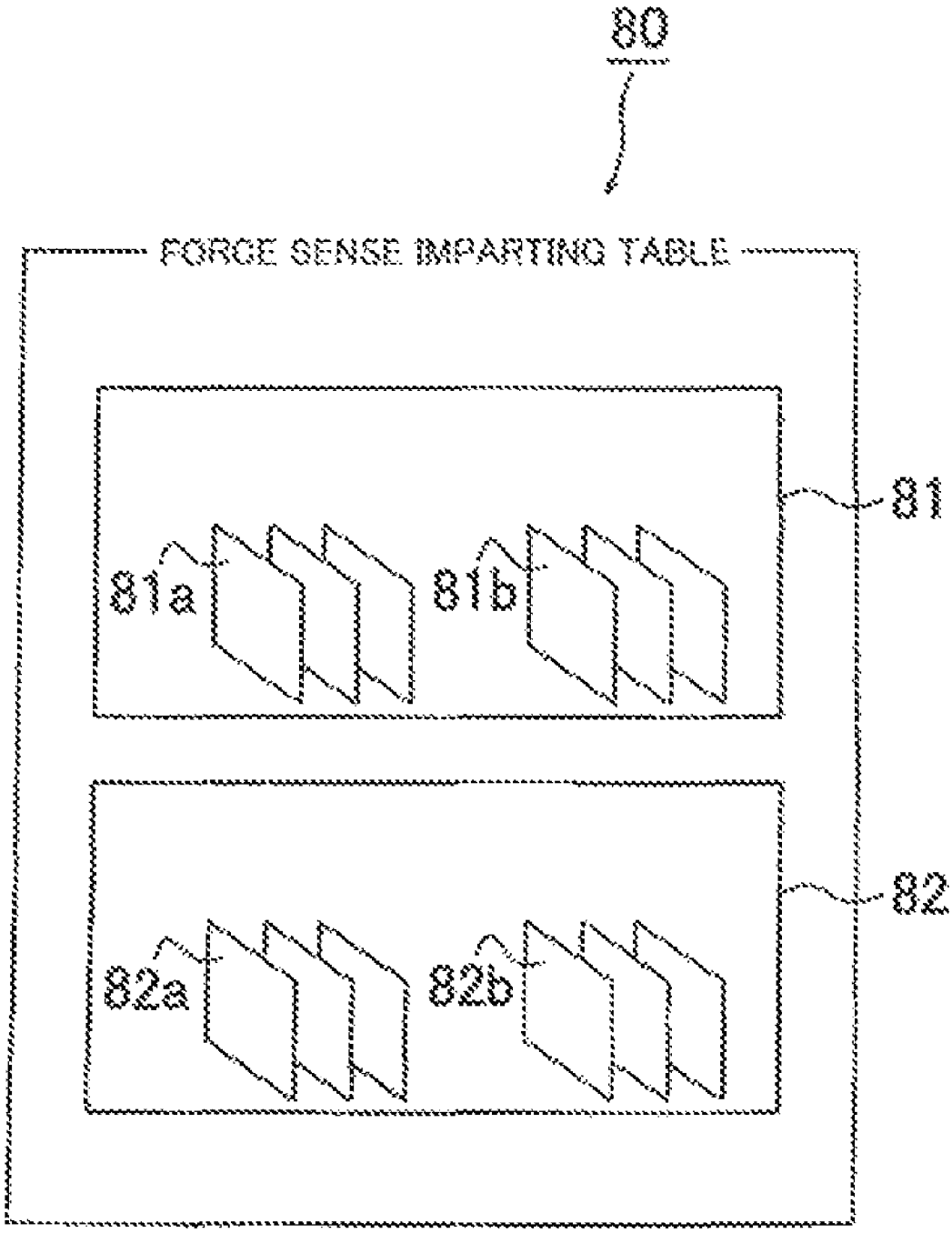
FIG. 6 is a diagram showing an example configuration of a force sense imparting table.

FIG. 6 is a diagram showing an example configuration of the force sense imparting table 80 stored in the ROM 52. The force sense imparting table 80 is a table containing patterns of driving forces to be generated by the electromagnetic actuator 40. Further, the force sense imparting table 80 includes a key depressing table 81 and a key releasing table 82. These key depressing table 81 and key releasing table 82 include reaction force pattern tables 81*a* and 82*a* and instruction value tables 81*b* and 82*b*, respectively. The reaction force pattern tables 81*a* and 82*a* are tables for referencing output values corresponding to signals indicative of detection values of the position sensor 47 (or values of velocity and acceleration calculated on the basis of the detection values). Further, the instruction value tables 81*b* and 82*b* are tables for referencing instruction values for causing the control driver 58 and PWM switching circuit 59 to generate the above-mentioned output values.

The following describe behavior of the keyboard apparatus 10 constructed in the aforementioned manner. When no key depressing force is acting on the key 20, the key 20 is held in the non-depressed position shown in FIG. 4A with the lower surface of the rear end region 20*b* of the key 20 held abutting against the upper key limit stopper 21 and the key depression section 20*c*, located in the front end region 20*a*, held in its uppermost position, because of intensity relationship between the biasing force, in the key depressing direction, produced by balance between masses (self-weights) before and behind the key pivot point 12 and the load applied from the mass member 30 to the key 20 via the transmission member 46. At that time, the shank section 32 of the mass member 30 is in its lower limit position abutting against the lower mass member limit stopper 35. Once the key 20 in the non-depressed position is depressed, the key 20 pivots about the key pivot point 12 in the key depressing direction while pushing upward the mass member 30 via the transmission member 46. In this manner, the key 20 pivots in the clockwise direction of FIG. 4A until the lower surface of the front end region 20*a* abuts against the lower key limit stopper 22, so that the key 20 takes the depressed position shown in FIG. 4B. When the key 20 is in the depressed position, the shank section 32 of the mass member 30, pushed upward by the key 20 via the transmission member 46, is in its upper limit position abutting against the upper mass member limit stopper 34. Then, once the key depressing force to the key 20 is removed, a load is applied from the mass member 30, pivoting in the counter-clockwise direction of FIG. 4B due to its self-weight, to the key 20 via the transmission member 46, so that the key 20 returns to the non-depressed position because of both the applied load and the self-weight balance.

By driving the transmission member 46 in the two directions by means of the electromagnetic actuator 40 when the key 20 moves using the inertial load of the mass member 30, the instant embodiment can assist or reduce the biasing force applied from the mass member 30 to the key 20. Thus, by the main control section 50 controlling the driving of the electromagnetic actuator 40, the instant embodiment can perform force sense control on a reaction force to be imparted key depression operation.

The following describe in greater detail the force sense control on key depression operation. In order to replicate or reproduce a particular key touch feeling (sense of resistance) felt through a finger on the basis of operation of an action mechanism of an acoustic piano, the instant embodiment of the keyboard apparatus 10 is constructed to impart a reaction force characteristic, corresponding to the key touch feeling of the acoustic piano, to the key 20 by driving the plunger 42 via the electromagnetic actuator 40 during a performance of the electronic keyboard instrument 1. The above-mentioned reaction force characteristic changes from moment to moment in response to a changing position of the key 20. Thus, in the aforementioned force sense control, a driving force is imparted on the basis of position information of the transmission member 46 detected by the position sensor 47. Namely, first, detection data generated by the position sensor 47 is output to the main control section 50. Then, the main control section 50 issues an instruction to the control driver 58 and PWM switching circuit 59 with reference to position information of the plunger 42 based on the detection data of the position sensor 47 and the force sense imparting table 80 stored in the ROM 52. Then, the control driver 58 and PWM switching circuit 59 supplies a driving current to the projecting coil 41*a* or retracting coil 41*b* on the basis of the instruction from the main control section 50. Thus, by driving of the projecting coil 41*a* or retracting coil 41*b*, a driving force is imparted to the transmission member 46 such that the transmission member 46 is driven toward the mass member 30 or the key 20. Whereas the instant embodiment has been described above in relation to the case where a driving force to be supplied by the electromagnetic actuator 40 is determined with reference to the force sense imparting table 80, such a driving force to be supplied by the electromagnetic actuator 40 may be determined through arithmetic operations based on the position information of the transmission member 46 detected by the position sensor 47.

Figure 7A:
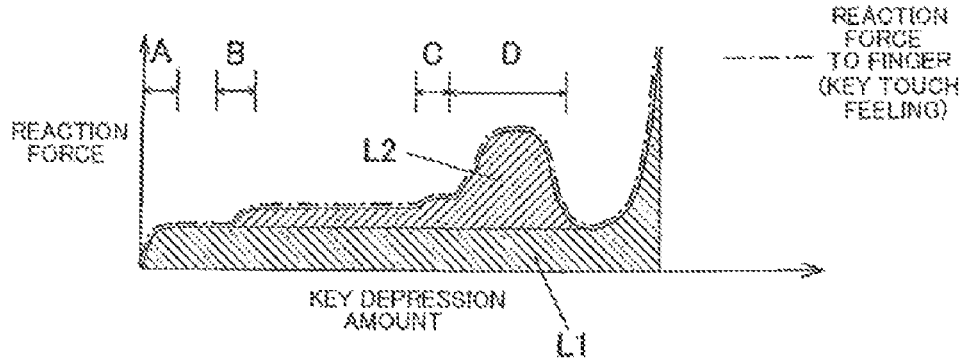
FIGS. 7A to 7D are graphs showing relationship between a displacement (depression amount) of the key and a reaction force (load) in a case where force sense control has been performed.
Figure 7B:
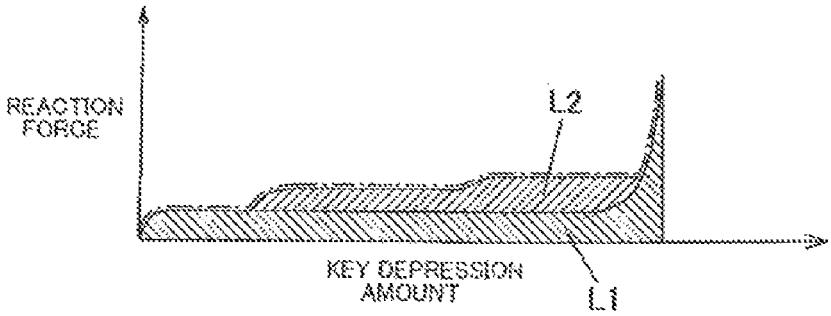
Figure 7C:
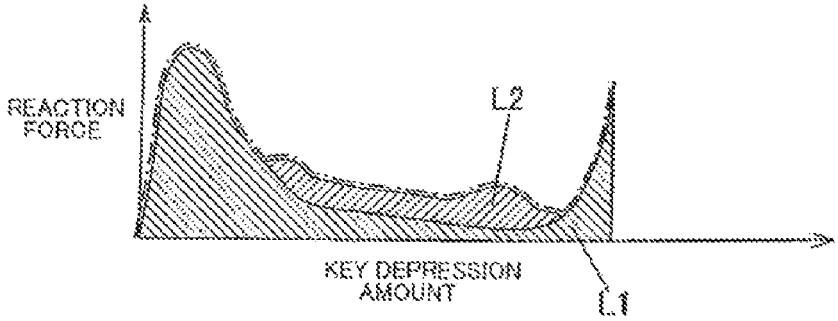
Figure 7D:
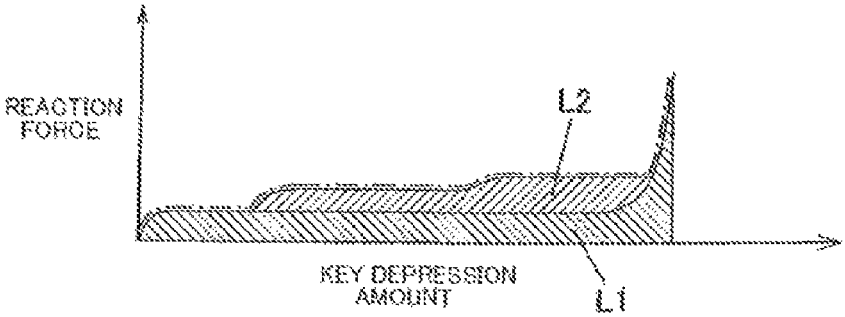

FIGS. 7A to 7D are graphs showing relationship between a displacement (depression amount) of the key 20 and a reaction force applied from the key 20 to a human player's finger depressing the key 20 in the case where the force sense control has been performed via the electromagnetic actuator 40, of which FIGS. 7A and 7B show distributions of reaction forces when the key 20 has been depressed and released relatively slowly while FIGS. 7C and 7D show distributions of reaction forces when the key 20 has been depressed and released relatively quickly.

With the force sense control performed on the key 20 in the instant embodiment of the keyboard apparatus 10, the reaction force applied from the key 20 to the human player's finger depressing the key 20 is a sum or of a reaction force L1 caused by the mass or inertial load of the mass member 30 acting on the key 20 and a reaction force L2 imparted to the key 20 by the electromagnetic actuator 40 (see one-dot-dash line in FIGS. 7A to 7D). The distribution of reaction forces applied to the human player's finger is results of cooperation between the reaction forces F1 of the mass member 30 and the reaction forces L2 imparted by the electromagnetic actuator 40 and thus can be said to be a reproduction of a distribution of reaction forces in an acoustic piano.

The following describe in greater detail the distributions of reaction forces to operation of the key 20. First, the distribution of reaction forces of FIG. 7A when the key 20 has been depressed relatively slowly is described. In this case, the reaction forces applied to the human player's finger depressing the key 20 exhibit a distribution starting at an initial value (zero load) corresponding to a zero key depression amount and including changes in four regions A, B, C and D.

Region A in FIG. 7A represents a reaction force distribution caused by static loads when the key 20 and mass member 30 start to be lifted from their rest states at an initial stage of depression of the key 20. At the initial stage of depression of the key 20, the plunger 42 has not yet been driven by the electromagnetic actuator 40, and only a reaction force from the mass member 30 is acting on the key 20. Although this region A is caused by the static loads of the key 20 and mass member 30 in their rest states, a similar distribution also appears in reaction force characteristics at an initial stage of depression of a key in an acoustic piano because of lifting of the key and corresponding hammer. Region B in FIG. 7A represents a reaction force distribution when driving, by the electromagnetic actuator 40, of the plunger 42 has been started, and in this region B are replicated or reproduced reaction forces applied to a key in an acoustic piano when the damper has started to be lifted by the key via an action mechanism.

Region C in FIG. 7A represents a distribution of reaction forces created by the driving of the electromagnetic actuator 40, where the reaction forces present an increase amount slightly smaller than that in region B. In this region C are replicated or reproduced reaction forces (so-called "action spring loads") imparted to a key in an acoustic piano through operation of various components of an action mechanism during depression of the key. Further, region D represents a mountain-shaped distribution of reaction forces, which involves rapid and great increase and decrease of reaction forces created through the driving of the actuator 40. In this region D is reproduced a rapid change of a load applied to a key in an acoustic piano by a jack escaping out of fitting engagement from a hammer roller. Note that the reaction force L1 applied from the mass member 30 to the key 20 rapidly increases again in a region following region D; this rapid increase is due to a reaction force which the mass member 30 receives from the upper mass member limit stopper 34 or which the key 20 receives from the lower key limit stopper 22.

Further, the distribution of reaction forces responsive to relatively slow release operation of the key 20 shown in FIG. 7B is generally similar to the distribution of reaction forces shown in FIG. 7A, except that there is no reaction force change corresponding to jack fitting/escaping loads in region D of FIG. 7A. In this case too, a distribution of reaction forces responsive to depression operation of a key in an acoustic piano is reproduced. Furthermore, the distribution of reaction forces responsive to relatively rapid depression of the key 20 shown in FIG. 7C is a mountain-shaped distribution involving rapid and great increase and decrease of the reaction force L1 caused by the mass member 30 at an initial stage of the key depression. This is because of great static loads caused when the key 20 and mass member 30 are rapidly moved from their rest states. With the relatively quick depression of the key 20, there appears almost no reaction force change which corresponds to a jack escaping load in an acoustic piano. The aforementioned reaction force distributions are generally similar to those occurring in actual key operation of an acoustic piano. With the relatively rapid depression of the key 20, as shown in FIG. 7D, the reaction force F1 applied from the mass member 30 remains substantially constant at small values, and reaction forces caused in an acoustic piano by various components of an action mechanism returning to their respective initial positions are reproduced as the reaction force L2 by the electromagnetic actuator 40. Consequently, the reaction forces in FIG. 7D present a distribution approximate to the distribution of reaction forces responsive to the relatively slow release operation of the key 20 shown in FIG. 7B.

Thus, with the instant embodiment of the keyboard apparatus 10, a distribution of reaction forces applied to a human player's finger in response to depression of a key in an acoustic piano including a complicated action mechanism can be faithfully reproduced by a combination of the reaction force L1 by the mass member 30 and the reaction force L2 created by the electromagnetic actuator 40.

Further, the instant embodiment of the keyboard apparatus 10 can reduce a force acting on the key 20 in the key releasing direction, by the electromagnetic actuator 40 driving the transmission member 46 in a direction (in this case, upward direction) opposite from the direction (in this case, downward direction) where a reaction force is applied to the key 20. Thus, the key 20 pivots by its own weight in the key depression direction by the electromagnetic actuator 40 driving the transmission member 46 upward when no operation is being performed by the human player on the key 20 resting in the non-depressed position. Utilizing such action, the keyboard apparatus 10 can automatically move the key 20 even without key depression operation by the human player. As a result, the electronic keyboard instrument 1 can execute an automatic performance involving automatic (i.e., unmanned) operation of the keys 20.

In such an automatic performance, instructions pertaining to the automatic performance are issued from the main control section 50 to the control driver 58 and PWM switching circuit 59, on the basis of the automatic performance data 85 stored in the ROM 52. On the basis of the instructions, the control driver 58 and PWM switching circuit 59 supply a driving current to the projecting coil 41*a*. Thus, the transmission member 46 is moved upward (i.e., toward the mass member 30) through the driving of the projecting coil 41*a*, so that the key 20 pivots to the depressed position. Once the supply of the driving current to the projecting coil 41*a* is terminated, the plunger 42 moves downward (toward the key 20) by the load from the mass member 30. Thus, a load is applied from the plunger 42 to the key 20 in the key releasing direction, so that the key 20 pivots to the released position. Such movement of the key 20 is performed at predetermined timing according to operation information of the keys 20 based on the automatic performance data, so that the keys 20 can perform motions conforming to predetermined performance tones.

Although not particularly shown, a stopper mechanism may be provided for holding the mass member 30 in its upper limit position abutting against the upper mass member limit stopper 34. Thus, when the electromagnetic actuator 40 drives the transmission member 46 to effect automatic (unmanned) operation of the key 20, the mass member 30 can be held still in the upper limit position by the stopper mechanism. This can prevent the load of the mass member 30 from being applied to the transmission member 46, and thus, the transmission member 46 can be driven with a minimum force. As a result, the instant embodiment can effectively cut down on electric power required for an automatic performance.

As set forth above, the instant embodiment of the keyboard apparatus 10 includes, as a main component for performing operation control of the key 20, the mass member 30 that imparts a reaction force to performance operation of the key 20 in interlocked relation to the movement of the key 20. In this way, the instant embodiment of the keyboard apparatus 10 can faithfully replicate or reproduce an inertial mass feeling characteristic of, or unique to, a natural keyboard instrument, such as an acoustic piano. The instant embodiment of the keyboard apparatus 10 can also appropriately reproduce an operational feeling at the start of depression of a key in an acoustic piano when movement of the key has to be started against the static load of the corresponding hammer. On that basis, the keyboard apparatus 10 includes the transmission member 46 that abuts against both of the key 20 and mass member 30 to transmit a load from one of the key 20 and mass member 30 to the other, and the electromagnetic actuator 40 that drives the transmission member 46 toward at least any one of the key 20 and mass member 30 by means of the fixed coils 41 (i.e., 41*a* and 41*b*). With such a transmission member 46 and electromagnetic actuator 40, it is possible to appropriately adjust the load (reaction force) to be imparted from the mass member 30 to the key 20, so that the keyboard apparatus 10 can readily achieve a key touch feeling extremely approximate to that of a natural keyboard instrument.

Furthermore, because the instant embodiment of the keyboard apparatus 10 includes the mass member 30 that imparts an inertial load to the key 20 in order to impart a key touch feeling to depression operation, by the human player, of the key 20, the keyboard apparatus 10 can provide a key touch feeling approximate to that of a natural keyboard instrument, such as an acoustic piano. Therefore, the load control to be performed by the electromagnetic actuator 40 in the keyboard apparatus 10 may be relatively simple control as compared to the load control performed in the force sense control by the conventionally-known keyboard apparatus, and yet the keyboard apparatus 10 of the invention can provide an extremely superior reproduction of a key touch feeling of a natural keyboard instrument. As a result, the instant embodiment of the keyboard apparatus 10 can faithfully achieve a key touch feeling approximate to that of a natural keyboard instrument, such as an acoustic piano.

Furthermore, by controlling the driving of the electromagnetic actuator 40, the instant embodiment of the keyboard apparatus 10 can adjust both the reaction force to be imparted from the mass member 30 to depression operation of the key 20 and the load acting from the mass member 30 on the key 20. As a result, the instant embodiment of the keyboard apparatus 10 can achieve both force sense control on key depression operation by adjusting the load acting from the mass member 30 on the key 20 and automatic operation of the key 20 by adjusting (increasing or decreasing) forces acting on the key 20 in the key depressing and releasing directions.

Furthermore, in the keyboard apparatus 10, the transmission member 46 to be driven by the electromagnetic actuator 40 is located between the key 20 and the mass member 30, and a driving force generated by the electromagnetic actuator 40 is impartable to both the key 20 and the mass member 30. Thus, a same operating system can be shared between the mass member 30 and the electromagnetic actuator 40 both operatively coupled with the key 20, so that the load acting from the mass member 30 on the key 20 can be appropriately controlled by the electromagnetic actuator 40 and thus the force sense control and driving control can be performed appropriately on the key 20.

Furthermore, in the keyboard apparatus 10, the mass member 30 includes the shank section (arm section) 32 for supporting the mass section 33 for pivoting movement in the region over the key 20, and the transmission member 46 is held in abutment with a portion of the key 20 located opposite from the key depression section 20*c* with respect to (i.e., as viewed from) the key pivot point 12 and with the shank section 32 of the mass member 30. Such a construction is equivalent to a construction where a wippen assembly disposed between a key and a hammer in an action mechanism of an acoustic piano is replaced with the transmission member 46 and electromagnetic actuator 40 of the present invention. Thus, by the transmission member 46 and electromagnetic actuator 40 performing the function of the wippen assembly of an acoustic piano, the instant embodiment of the keyboard apparatus 10 can achieve a key touch feeling extremely approximate to that of an acoustic piano with minimum necessary structural arrangements and control. In addition, the instant embodiment of the keyboard apparatus 10 can perform an automatic performance involving automatic operation of the keys 20.

Furthermore, the key 20 provided in the keyboard apparatus 10 is a component part similar in construction and operation to a key of an acoustic piano, and the mass member 30 is a component part similar in construction and operation to a hammer of an acoustic piano. Using such component parts similar to a key and hammer of an acoustic piano, the keyboard apparatus 10 allows the static load and dynamic load of the key 20 to be approximate to those of an acoustic piano.

Furthermore, in the keyboard apparatus 10, the mass member 30 is pivotably supported over the key 20, and the electromagnetic actuator 40 and transmission member 46 are disposed between a portion of the key 20 located opposite from the key depression section 20*c* with respect to (i.e., as viewed from) the key pivot point 12 and the mass member 30. Such a construction is equivalent to a construction where a wippen assembly disposed between a key and a hammer in an action mechanism of an acoustic piano is replaced with the electromagnetic actuator 40 and transmission member 46. Thus, by the electromagnetic actuator 40 and transmission member 46 performing the function of the wippen assembly of an acoustic piano, the instant embodiment of the keyboard apparatus 10 can achieve a key touch feeling extremely approximate to that of an acoustic piano with minimum necessary structural arrangements and control. In addition, the instant embodiment of the keyboard apparatus 10 can perform an automatic performance involving automatic operation of the keys 20.

However, the key 20 and mass member 30 need not necessarily be constructed similarly to a key and mass member of an acoustic piano. In the case where the key 20 and mass member 30 are constructed differently from a key and mass member of an acoustic piano, influences which the key 20 has on a key touch feeling can be covered by controlling the driving force to be imparted to the key 20 and mass member 30 by means of the electromagnetic actuator 40.

Second Embodiment

Next, a description will be given about a second embodiment of the keyboard apparatus of the present invention. Similar elements to those in the first embodiment are indicated by the same reference numerals as used for the first embodiment and will not be described here to avoid unnecessary duplication. Namely, elements not described in the following description are similar to those in the first embodiment; the same can be said for the third and succeeding embodiments.

Figure 8:
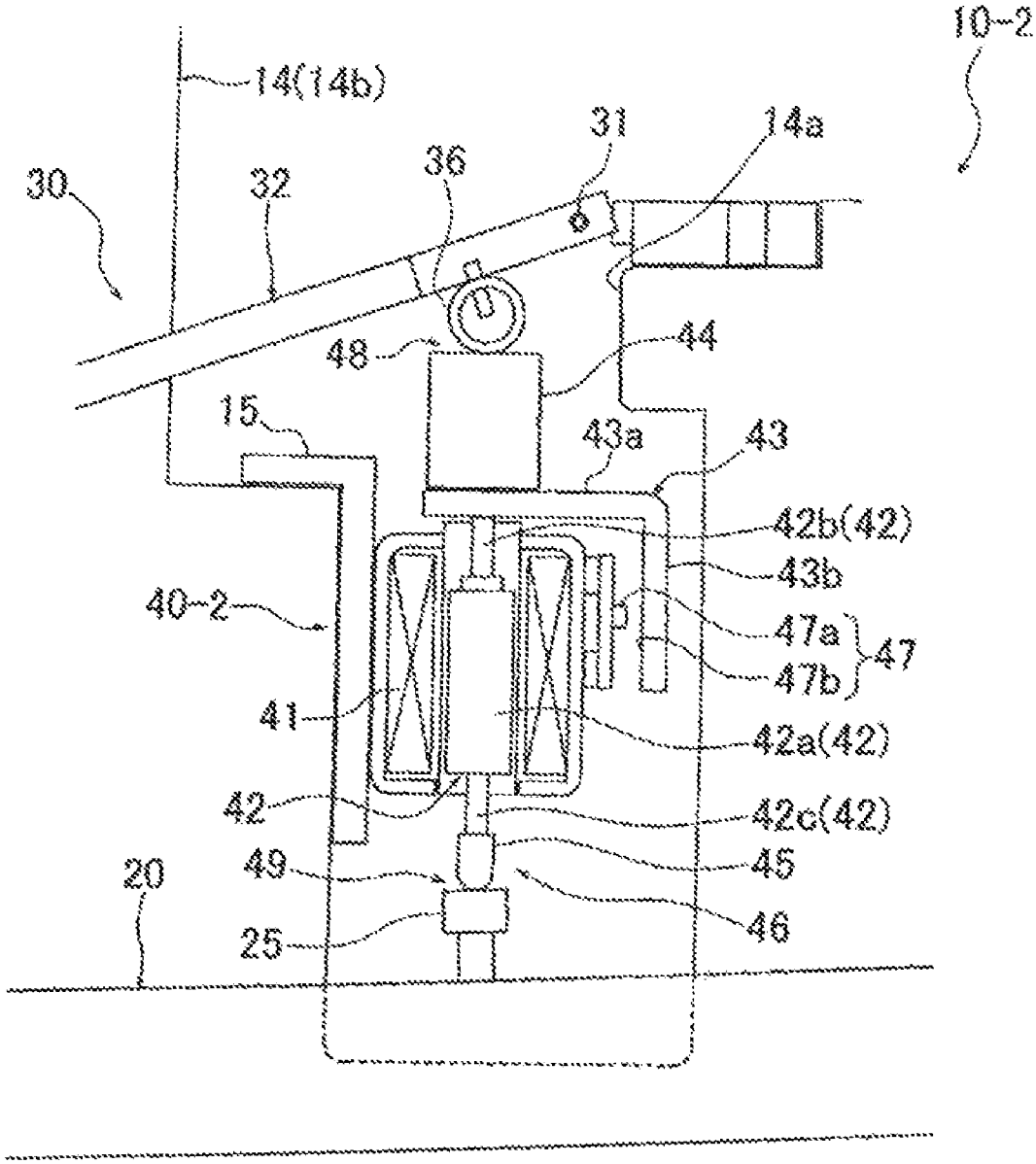
FIG. 8 is a view showing a construction of a second embodiment of the keyboard apparatus of the present invention.

FIG. 8 is a view showing a construction of the second embodiment of the keyboard apparatus 10-2, which includes a uni-directionally driven electromagnetic actuator 40-2 in place of the bi-directionally driven electromagnetic actuator 40 provided in the first embodiment of the keyboard apparatus 10. In other structural respects, the second embodiment of the keyboard apparatus 10-2 is similar to the first embodiment of the keyboard apparatus 10. More specifically, the uni-directionally driven electromagnetic actuator 40-2 includes a single coil 41 and a plunger 42 provided inside the coil 41, and it is constructed to move the plunger 42 only in a downward direction (i.e., toward the key 20) through driving of the coil 41. Further, although not particularly shown, a drive control circuit in the second embodiment of the keyboard apparatus 10-2 has a construction for controlling the driving operation of the electromagnetic actuator 40-2 having the single coil 41.

By the electromagnetic actuator 40-2 driving the transmission member 46 downwardly toward the key 20, a combination of a reaction force based on a mass or inertial load of the mass member 30 acting on the key 20 and a reaction force imparted to the key 20 by the actuator 40 becomes a reaction force applied to a finger of the human player performing depression operation of the key 20. Thus, the second embodiment of the keyboard apparatus 10-2 can create distributions of reaction forces similar to those of FIG. 7 created by the first embodiment and can perform force sense control on performance operation of the key 20.

The second embodiment of the keyboard apparatus 10-2, provided with the uni-directionally driven electromagnetic actuator 40-2, can be simplified in construction and can facilitate the driving control of the electromagnetic actuator 40-2 as compared to the first embodiment. Thus, the second embodiment of the keyboard apparatus 10-2 is suited for application to electronic keyboard instruments of simpler construction and inexpensive electronic keyboard instruments.

Third Embodiment

Figure 9:
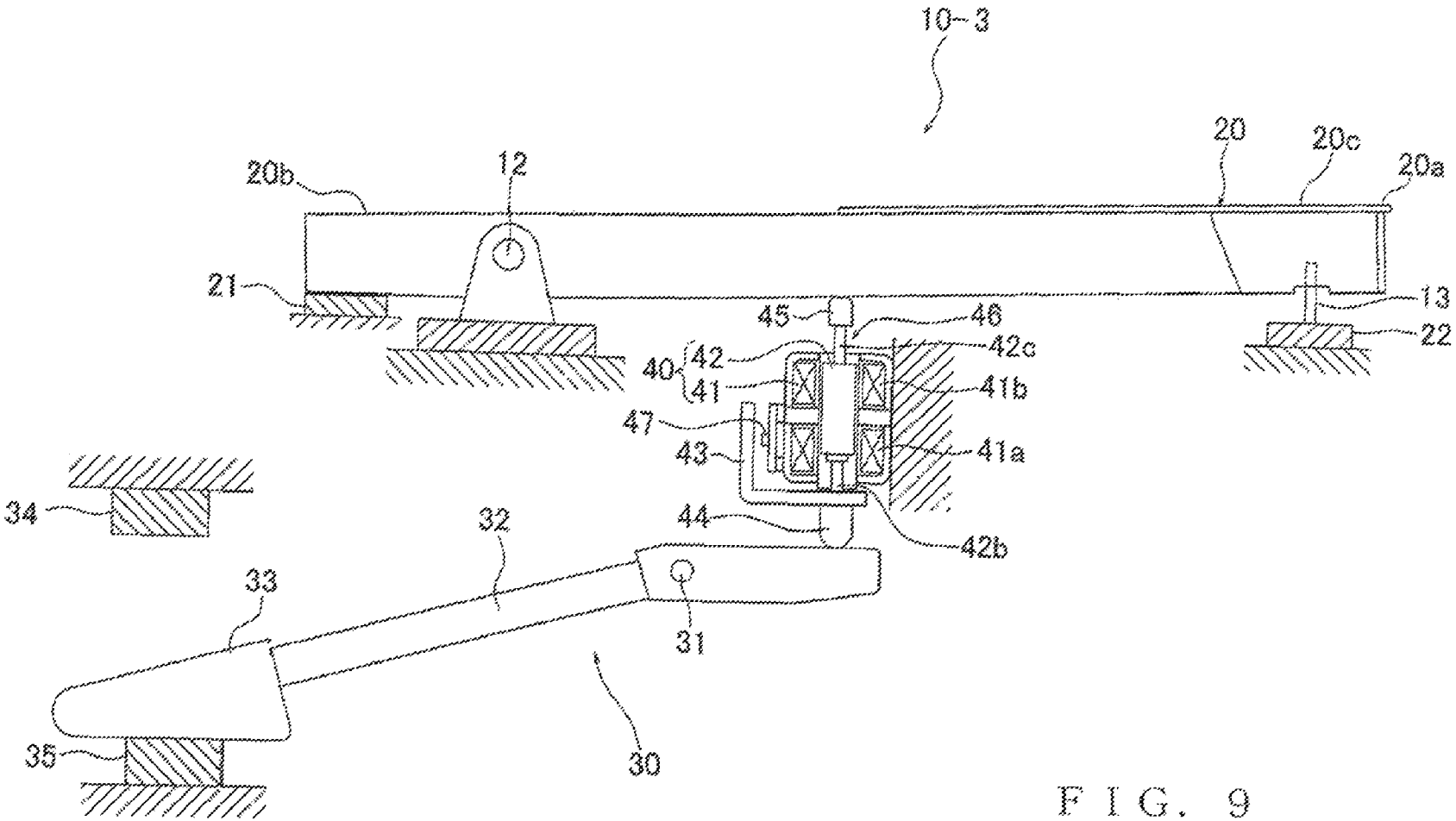
FIG. 9 is a view showing a construction of a third embodiment of the keyboard apparatus of the present invention.

Next, a description will be given about a third embodiment of the keyboard apparatus of the present invention. FIG. 9 is a view showing a construction of the third embodiment of the keyboard apparatus 10-3. In the third embodiment of the keyboard apparatus 10-3, vertical positional relationship between the key 20 and the mass member 30 is reversed from that in the first embodiment of the keyboard apparatus 10, and hence an orientation of the electromagnetic actuator 40 provided between the key 20 and the mass member 30 is reversed from that in the first embodiment of the keyboard apparatus 10. Also, respective operating directions of the key 20, mass member 30 and electromagnetic actuator 40 are reversed from those in the first embodiment of the keyboard apparatus 10.

Namely, in the third embodiment of the keyboard apparatus 10-3, the mass member 30 is disposed under the key 20, and the electromagnetic actuator 40 and transmission member 46 are disposed between the lower surface of the key 20 and the mass member 30. In the transmission member 46, the upper end of the second rod 42*c* extending upward is held in abutment with a lower surface portion of the key 20 located forwardly of the key pivot point 12 (i.e., located on the same side as the key depression section 20*c* with respect to the key pivot point 12), and the lower end of the support member 44 fixed to the first rod 42*b* extending downward is held in abutment with an upper surface portion of the shank section 32 extending in an opposite direction from the mass member 33 with respect to the mass member pivot point 31.

Whereas the key 20, electromagnetic actuator 40 and transmission member 46 and mass member 30 in the first embodiment of the keyboard apparatus 10 are arranged from down to up in the order mentioned on a side (rear side) opposite from the key depression section 20*c* with respect to (i.e., as viewed from) the key pivot point 12, the key 20, electromagnetic actuator 40 and transmission member 46 and mass member 30 in the third embodiment of the keyboard apparatus 10-3 are arranged from up to down in the order mentioned on the same front side as the key depression section 20*c*. Namely, in the third embodiment of the keyboard apparatus 10-3, the mass member 30 includes the shank section (arm section) 32 supporting the mass section 33 for pivoting movement in a region under the key 30, and the transmission member 46 is held in abutment with a portion of the arm section 32 located on the same side of the key depression section 20*c* with respect to (i.e., as viewed from) the key pivot point 12.

In the third embodiment of the keyboard apparatus 10-3 too, when no depressing operation of the key 20 is being performed, the key 20 is held in the non-depressed position with the lower surface of the rear end region 20*b* of the key 20 held abutting against the upper key limit stopper 21, as shown in FIG. 9, because of both balance between self-weights before and behind the key pivot point 12 and the load applied from the mass member 30 to the key 20 via the transmission member 46. At that time, the mass member 30 is in its lower limit position abutting against the lower mass member limit stopper 35. Once the key 20 in the non-depressed position is depressed, the key 20 pivots about the key supporting position 12 while pushing downward the shank section 32 of the mass member 30 via the transmission member 46. In this manner, the key 20 pivots to the depressed position where the lower surface of the front end region 20*a* abuts against the lower key limit stopper 22. The mass member 30, having pivoted by being pushed downward by the key 20 via the plunger 42, is held in its upper limit position abutting against the upper mass member limit stopper 34 while the key 20 is in the depressed position. Then, once the key depressing force to the key 20 is removed, a load is applied from the pivoting mass member 30 to the key 20 via the transmission member 46, so that the key 20 returns to the non-depressed position because of both the applied load and the self-weight balance.

Whereas the embodiments according to the first aspect of the present invention have been described above, the present invention should not be construed as limited to the described embodiments and may be modified variously within the scope of the technical ideas set forth in the appended claims and the specification and drawings. For example, the roller 36 mounted on the shank section 32 in the first and second embodiments of the keyboard apparatus 10 and 10-2 may be replaced with any other suitable member as long as the replacing member can perform appropriate shock absorbing and sliding functions with respect to the transmission member 46. As an example, the roller 36 may be a bearing member including a contact portion with a spherical surface. Alternatively, the transmission member 46 may be abutted directly against the key 20 with the roller 36 omitted.

Further, the embodiments according to the first aspect of the present invention have been described above as applied to the electronic keyboard instrument 1 having the electronic tone generator that generates a tone in response to operation of any one of the keys 20. Thus, in these described embodiments, each of the mass members 30 only has the function of merely imparting an inertial mass to the key 20 to create a key touch feeling approximate to that of a natural keyboard instrument, such as an acoustic piano; namely, the mass member 30 in each of the above-described embodiments does not have a function of actually striking a string to generate a tone. However, the keyboard apparatus of the present invention is not limited to such a described construction, and the mass member 30 may have the function of actually striking, like a hammer member of an acoustic piano, a string to generate a tone, in which case the mechanism for generating an electronic tone in response to operation of the key may be dispensed with.

Fourth Embodiment

Next, fourth to eights embodiments according to a second aspect of the present invention will be described with reference to FIGS. 10 to 16. Note that the force sense control of FIGS. 5 to 7 is also applied to the fourth to eights embodiments in the aforementioned manner.

Figure 10:
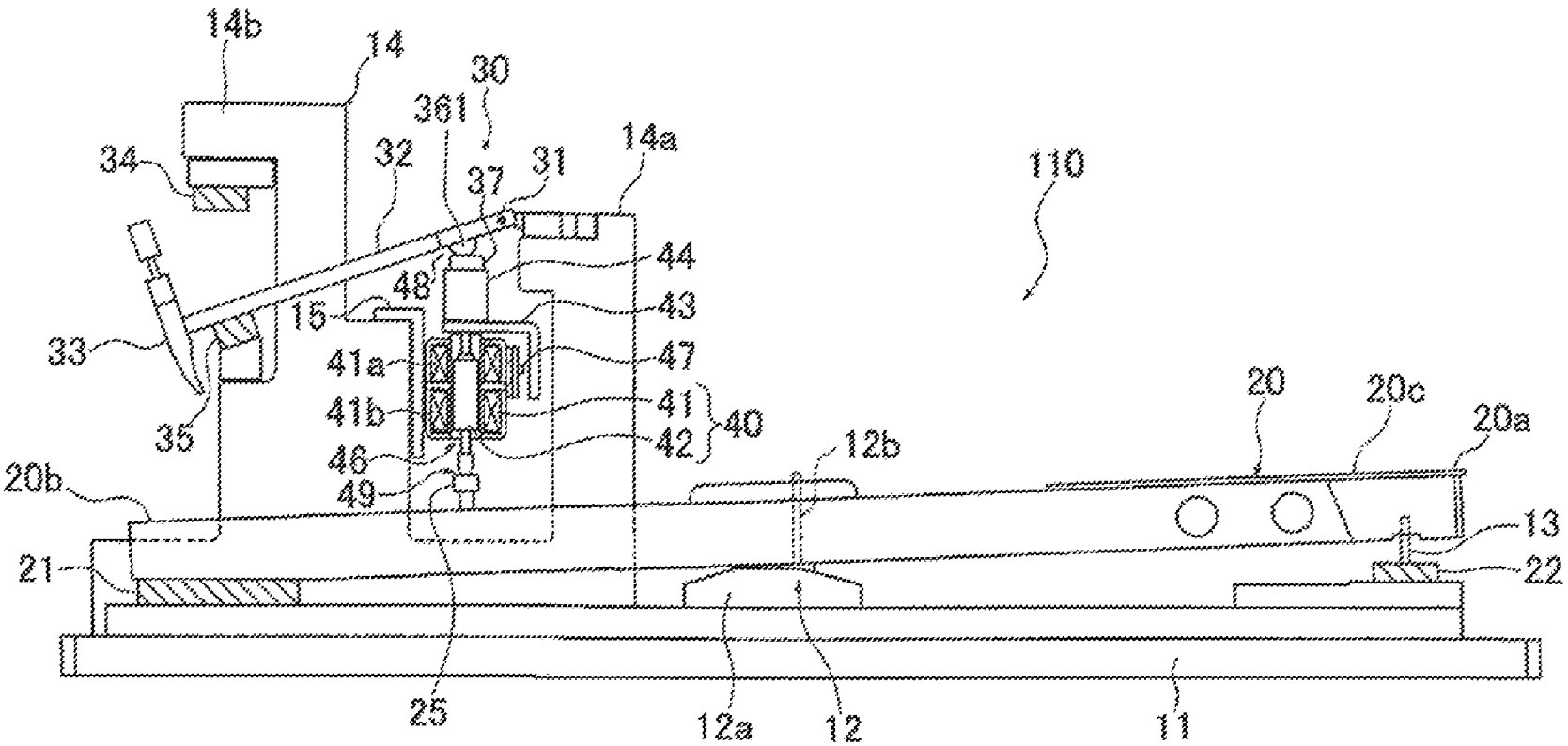
FIG. 10 is a schematic side view of a fourth embodiment of the keyboard apparatus of the present invention, which particularly shows the key and other component parts around the key.
Figure 11:
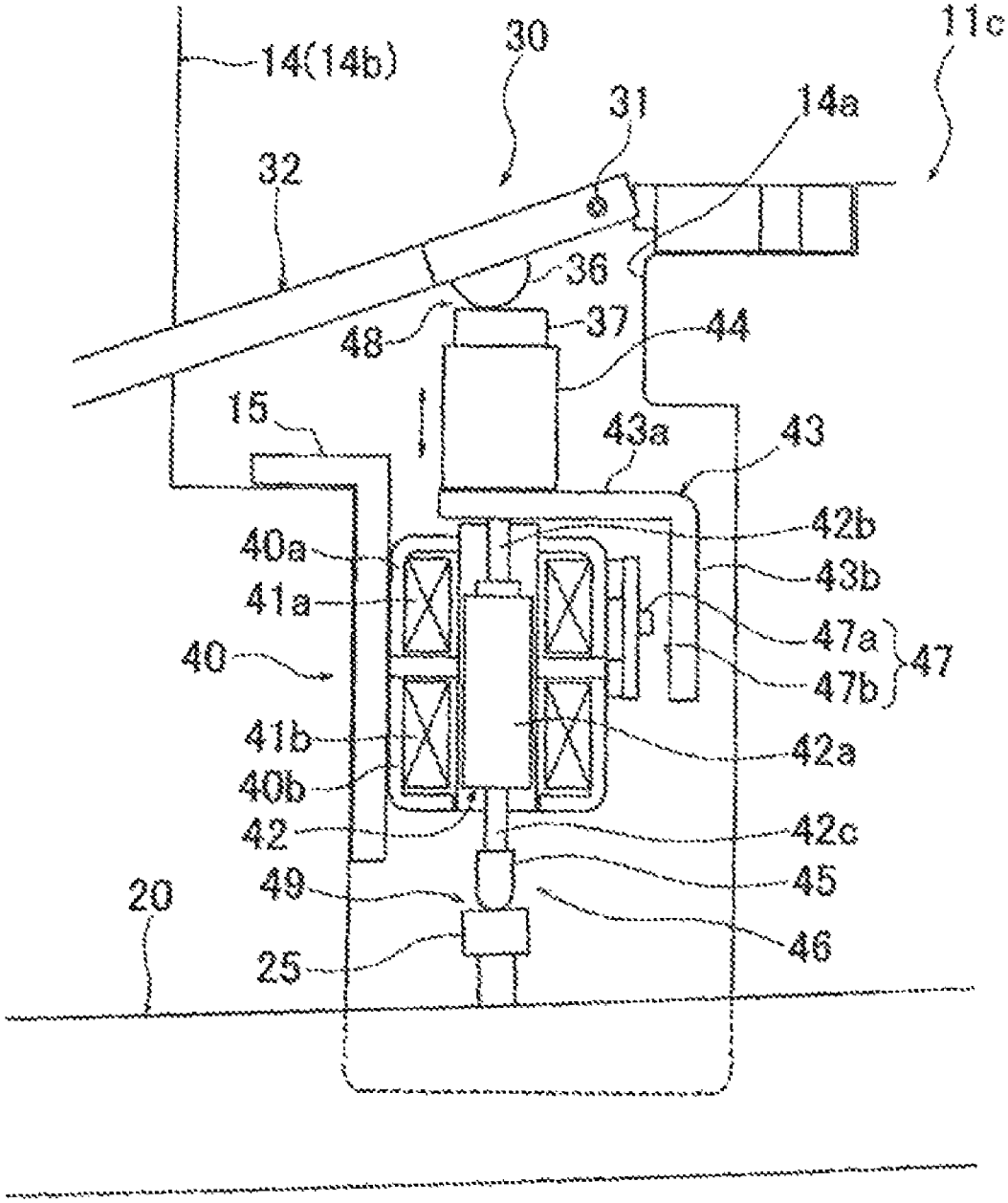
FIG. 11 is a fragmentary enlarged side view showing detailed constructions of the electromagnetic actuator and other component parts around the actuator.
Figure 12A:
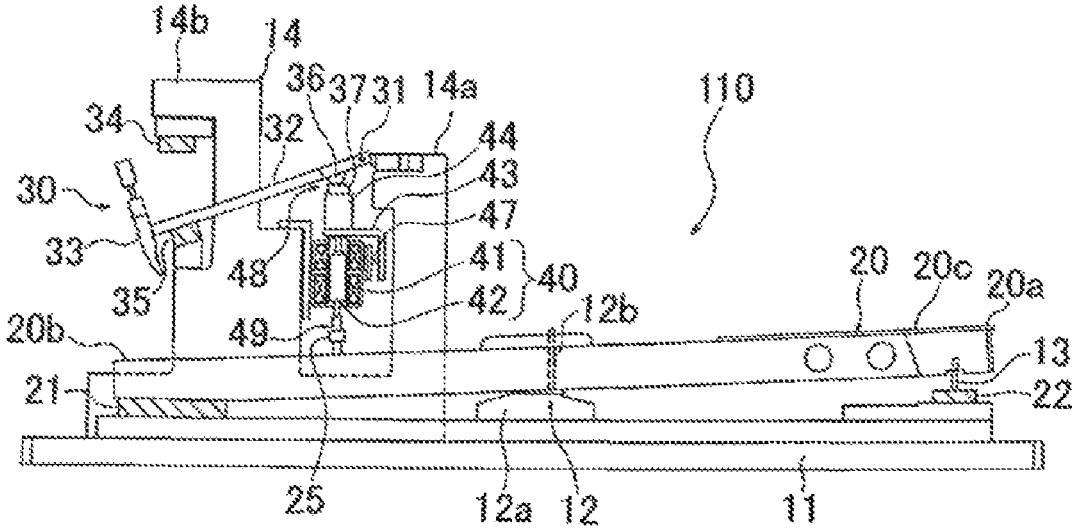
Figure 12B:
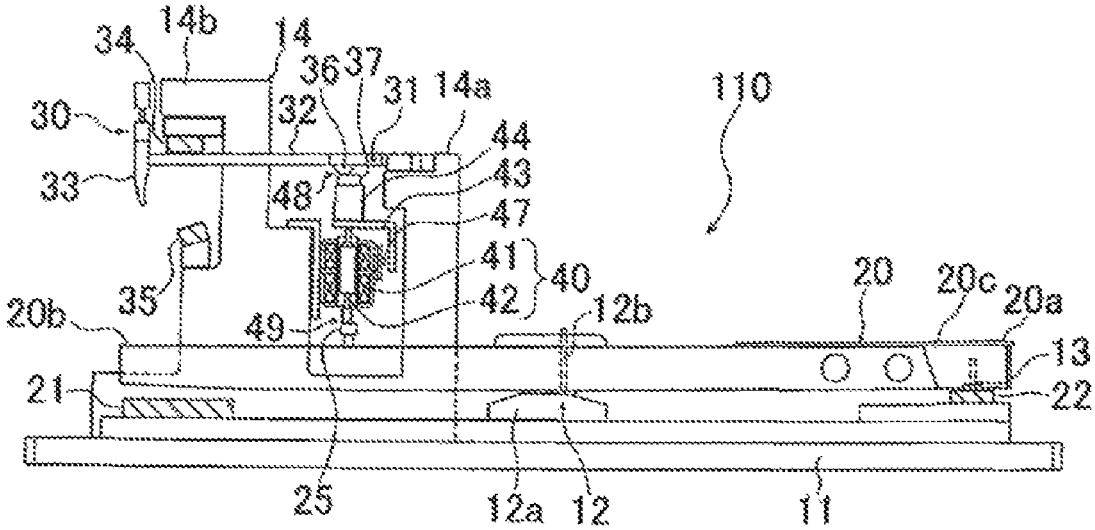

FIG. 10 is a schematic side view of the fourth embodiment of the keyboard apparatus 110, which particularly shows one of the keys 20 and other component parts around the key 20. FIG. 11 is a fragmentary enlarged side view showing detailed constructions of the electromagnetic actuator 40 and other component parts around the actuator 40. Further, FIGS. 12A and 12B are views explanatory of behavior of the keyboard apparatus 110 shown in FIG. 10, of which FIG. 12A shows a state where the key 20 is in the non-depressed position while FIG. 12B shows a state where the key 20 is in the depressed position.

In FIG. 10, similar elements to those in the first embodiment of the keyboard apparatus 10 of FIG. 2 are indicated by the same reference numerals as used for the first embodiment and will not be described here to avoid unnecessary duplication. The keyboard apparatus 110 of FIG. 10 is different from the keyboard apparatus 10 of FIG. 2 in that a bearing 361 formed of magnetic metal is provided on the shank section 32, in the abutment area 48, so as to be attracted by a permanent magnet 37 provided on the upper surface of the support member 44 in the keyboard apparatus 110 while the roller 36 provide on the shank section 32 of the mass member 30 is held, in the abutment area 48, in abutment with the upper surface of the support member 44 in the keyboard apparatus 10 of FIG. 2. In other structural respects, the fourth embodiment of the keyboard apparatus 110 is substantially similar to the first embodiment of the keyboard apparatus 10.

Referring to FIG. 11, the support member 44 having a horizontal surface is fixed to the upper surface of the body portion 43*a* of the plate member 43, and the magnet (permanent magnet) 37 is fixed to the horizontal surface of the support member 44. The magnet 37 is a small-size member formed in a substantially flat plate shape. The bearing (attracted member) 361 formed of a magnetic substance attractable to the magnet 37 is fixed on a portion of the shank section 32 opposed to the support member 44. The bearing 361 is a small-size member of a substantially semispherical shape, formed of a metal material and fixed to the lower surface of the shank section 32. The bearing 361 is held attached to the magnet 37 by magnetic attaching force.

It is desirable that the magnetic attaching force between the bearing 361 and the magnet 37 have the following intensity. Namely, it is desirable that the intensity of the magnetic attaching force be such that, when the key 20 and the mass member 30 are in normal operating condition, the bearing 361 and the magnet 37 are held attached together in the first abutment area 48 so that the transmission member 46 can operate integrally with the mass member 30 while being held abutting against the mass member 30, and that, when the key has been depressed extremely rapidly with a great depressing force or depressed or released at an extremely high speed, the bearing 361 and the magnet 37 may be instantaneously detached from each other if acceleration produced in the transmission member 46 and acceleration produced in the mass member 30 differs in direction.

The above-mentioned plunger 42 (including the body portion 42*a*, first rod 42*b* and second rod 42*c*), plate member 43, support member 44 and magnet 37 together constitute the transmission member 46 for transmitting a load (i.e., load by mass or inertial load produced by pivoting movement) from any one of the key 20 and mass member 30 to the other. The transmission member 46 is held sandwiched between the mass member 30 and the key 20 by the self-weight of the mass member 30. As set forth above, the electromagnetic actuator 40 can drive the transmission member 46 (more specifically, plunger 42) in two directions by the projecting coil 41*a* and retracting coil 41*b* being supplied with driving currents. The key 20 is normally biased in the key-releasing direction by the load (i.e., load by the mass of the mass member 30) applied thereto from the mass member 30 via the transmission member 46, so that the key 20 is caused to pivot in the key depressing direction as the load from the mass member 30 is reduced by the driving force of the electromagnetic actuator 40.

While the key 20 and mass member 30 vertically pivot about the respective pivot points 12 and 31, the transmission member 46 (plunger 42) linearly moves in its axial direction inside the projecting coil 41*a* and retracting coil 41*b*. Thus, when the key 20, mass member 30 and transmission member 46 move integrally with one another, the magnet 37 vertically moving in response to the motion of the transmission member 46 slides on and along the bearing 361 angularly moving in response to the vertical pivoting movement of the mass member 30, in the first abutment area 48 where the magnet 37 provided on the transmission member 46 and the bearing 361 provided on the mass member 30 are normally held in abutment with each other.

Note that the force sense control described above with reference to FIGS. 5 to 7D in relation the first embodiment is also applied to the fourth embodiment in the aforementioned manner.

Namely, the fourth embodiment of the keyboard apparatus 110 includes the mass member 30 for imparting a reaction force to performance operation of the key 20 in interlocked relation to the key 20. Thus, the fourth embodiment of the keyboard apparatus 110 can faithfully reproduce an inertial mass feeling characteristic of, or unique to, key operation in a natural keyboard instrument, such as an acoustic piano. Further, the fourth embodiment of the keyboard apparatus 110 can also appropriately reproduce an operational feeling at the start of depression of a key in an acoustic piano where movement of the key has to be started against the static load of the corresponding hammer.

Further, in the fourth embodiment of the keyboard apparatus 110, the mass member 30 and the transmission member 46 are detachably attached to each other, in the first abutment area 48, through the magnetic attracting force between the bearing 361 fixed to the mass member 30 and the magnet 37 fixed to the transmission member 46. Because the mass member 30 and the transmission member 46 are detachably attached to each other through the magnetic attracting force of the magnet as noted above, the magnet 37 and the bearing 361 move, during operation of the mass member 30 and the transmission member 46, while rubbing against each other. Thus, during operation of the mass member 30 and transmission member 46, the mass member 30 and the transmission member 46 are allowed to move relatively freely relative to each other while being kept in contact with each other. Therefore, in the keyboard apparatus 110, interlocked operational relationship between the mass member 30 and the transmission member 46 can be secured such that the mass member 30 and the transmission member 46 are allowed to perform different (i.e., pivotal and linear) movement. Further, because the mass member 30 and the transmission member 46 are attached to each other through the magnetic attracting force provided by the magnet 37, the fourth embodiment of the keyboard apparatus 110 can achieve, with a simple mechanism, a construction where, as the mass member 30 operates, the mass member 30 and the transmission member 46 are allowed to move relatively freely relative to each other while being kept in contact with each other.

Furthermore, in the first abutment area 48 where the mass member 30 and the transmission member 46 are held in abutment with each other, a certain frictional force is produced by the magnetic force therebetween. Thus, the keyboard apparatus 110 can appropriately replicate or reproduce a key operating feeling resulting from friction produced within an action mechanism of an acoustic piano. As a result, the keyboard apparatus 110 can also achieve an operational feeling approximate to rebound checking operation (i.e., "backcheck operation") after a hammer abuts a stopper member in an action mechanism of an acoustic piano; namely, the keyboard apparatus 110 can achieve a so-called pseudo backcheck operation feeling.

In addition, with the mass member 30 and the transmission member 46 attached to each other through the magnetic attracting force, force transmission between the mass member 30 and the transmission member 46 can be effected steadily and reliably. As a result, the keyboard apparatus 110 can more faithfully reproduce an operational feeling of an acoustic piano. Further, with the mass member 30 and the transmission member 46 magnetically attached to each, the mass member 30 can quickly return to its initial position by being taken by the key 20, as the key 20 returns to its initial position. Thus, a state where next tone generation by the key 20 is enabled can be achieved quickly, which permits performance of quick passages.

Furthermore, the fourth embodiment of the keyboard apparatus 110 is constructed in such as manner that the bearing 361 fixed to the mass member 30 angularly moves in response to pivoting movement of the mass member 30 while the magnetic 37 fixed to the transmission member 46 linearly moves in response to vertical movement of the transmission member 46, and that the bearing 361 and the magnet 37 slide relative to each other at their magnetically-joined portions. Therefore, the bearing 361 and the magnet 37 are allowed to slidingly move relative to each other with a relatively high degree of freedom while maintaining the magnetically-attached state at their respective abutting portions. In this way, the fourth embodiment of the keyboard apparatus 110 permits relative movement between the mass member 30 and the transmission member 46 with appropriate frictional force (static and dynamic frictional force) while securing interlocked operational relationship between the mass member 30 and the transmission member 46, as a result of which it can achieve improved behavior and operational feeling of the key 20.

Further, in the fourth embodiment of the keyboard apparatus 110, the surface of the bearing 361 abutting against the magnet 37 is a spherical curved surface, so that the surface of the bearing 361 and the magnet 37 slide relative to each other with an appropriate frictional force. Thus, the keyboard apparatus 110 can achieve even further improved behavior and operational feeling of the key 20.

Fifth Embodiment

Next, a description will be given about a fifth embodiment of the keyboard apparatus of the present invention. In the following description about the fifth embodiment and related figures, similar elements to those in the above-described first to fourth embodiments are indicated by the same reference numerals as used for the first to fourth embodiments and will not be described here to avoid unnecessary duplication. Namely, elements not described in the following description are similar to those in the first embodiment; the same can be said for the sixth and succeeding embodiments.

Figure 13:
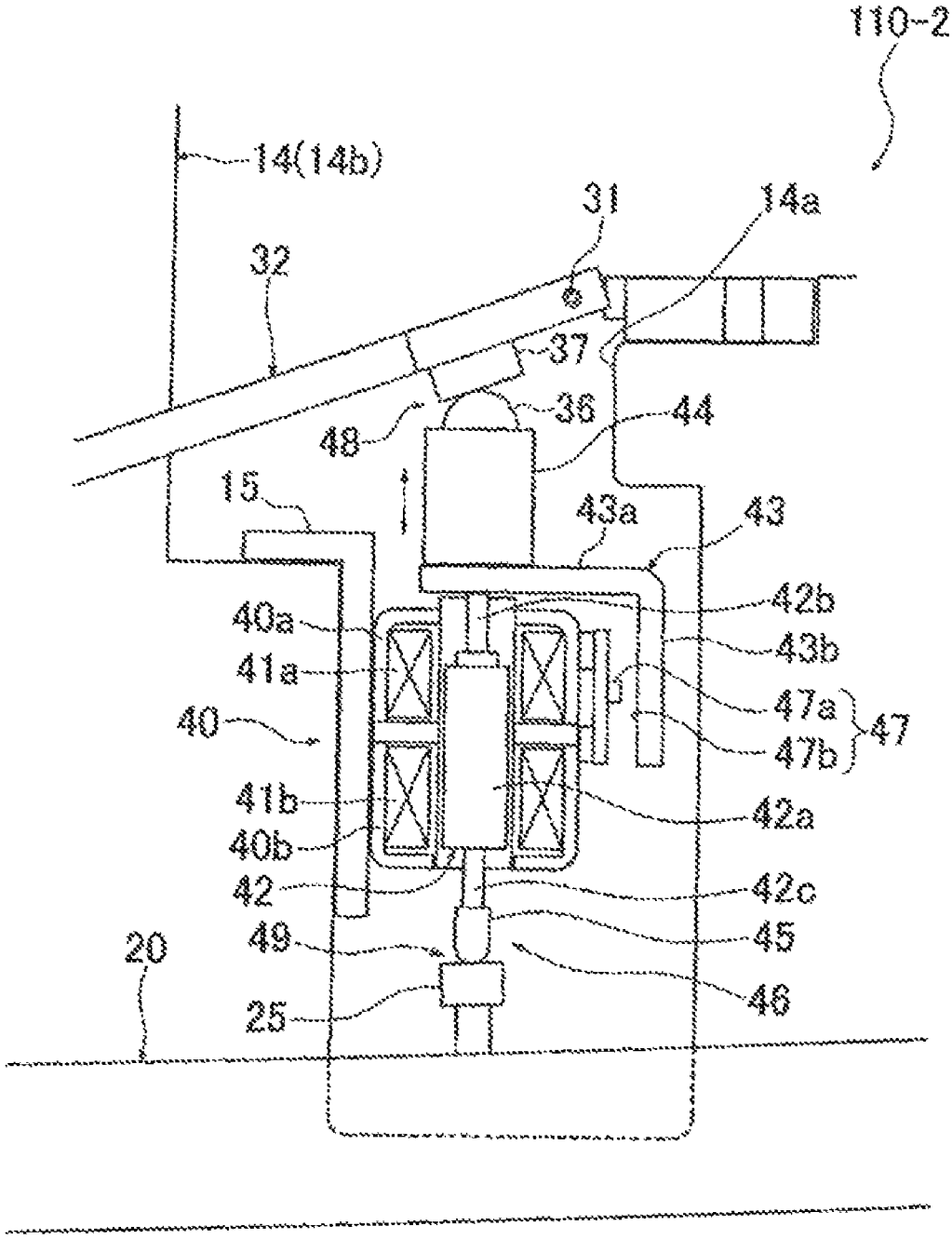
FIG. 13 is a fragmentary enlarged view showing a construction of a fifth embodiment of the keyboard apparatus of the present invention.

FIG. 13 is a fragmentary enlarged view, similar to FIG. 11 pertaining to the fourth embodiment, showing a construction of the fifth embodiment of the keyboard apparatus 110-2 of the present invention, which particularly shows detailed constructions of the electromagnetic actuator and other components around the electromagnetic actuator. In the keyboard apparatus 110-2 shown in FIG. 13, the magnet 37 is fixed to the mass member 30, while the bearing 361 is fixed to the transmission member 46. Namely, the bearing 361 is fixed to the upper surface of the support member 44, while the magnet 37 is fixed to the shank section 32 of the mass member 30. In this keyboard apparatus 110-2 too, the transmission member 46 and the mass member 30 are normally held attached to each other through a magnetic force between the magnet 37 and the bearing 361 in the first abutment area 48. The magnet 37 and the bearing 361 are similar in shape to those shown in FIG. 11. Although not particularly shown, the shapes of the magnet (attraction member) 37 and the bearing 361 may be changed with each other. Alternatively, magnets may be fixed to both of the mass member 30 and transmission member 46 so that mutually-abutting portions of the mass member 30 and transmission member 46 are attached to each other with mutually-attracting forces of the two magnets.

Sixth Embodiment

Figure 14:
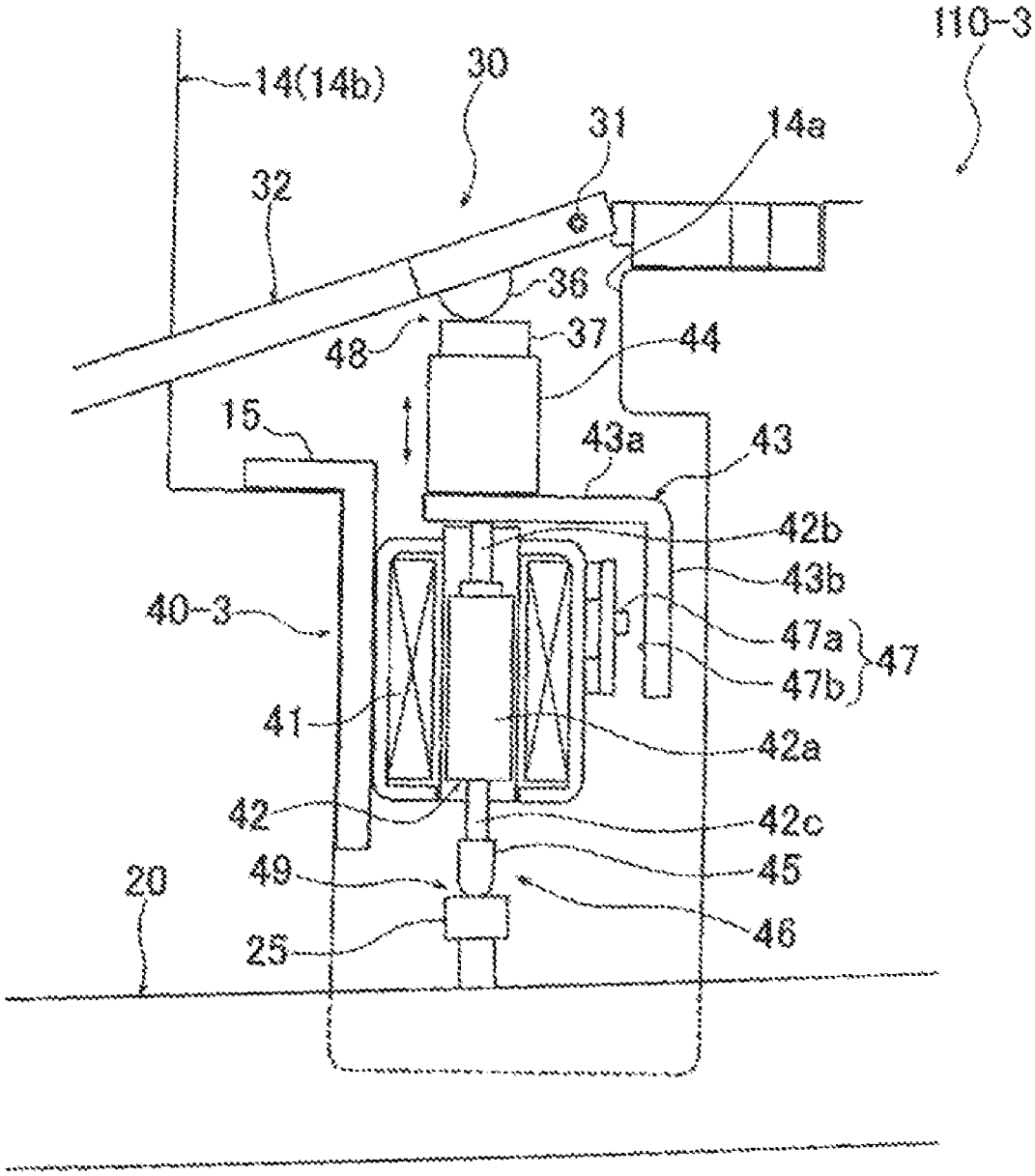
FIG. 14 is a fragmentary enlarged view showing a construction of a sixth embodiment of the keyboard apparatus of the present invention.

Next, a description will be given about a sixth embodiment of the keyboard apparatus of the present invention. FIG. 14 is a fragmentary enlarged view showing a construction of the sixth embodiment of the keyboard apparatus 110-3 of the present invention. The sixth embodiment of the keyboard apparatus 110-3 includes a uni-directionally driven electromagnetic actuator 40-3 in place of the bi-directionally driven electromagnetic actuator 40 provided in the fourth embodiment of the keyboard apparatus 110. In other structural respects, the sixth embodiment of the keyboard apparatus 110-3 is similar to the fourth embodiment of the keyboard apparatus 110. Namely, the uni-directionally driven electromagnetic actuator 40-3 includes a single coil 41 and a plunger 42 provided inside the coil 41, and it is constructed to move the plunger 42 only in the downward direction (i.e., toward the key 20) through driving of the coil 41. Further, although not shown, a drive control circuit in the sixth embodiment of the keyboard apparatus 110-3 has a construction for controlling the driving operation of the electromagnetic actuator 40-3 having the single coil 41.

By the electromagnetic actuator 40-3 driving the transmission member 46 downwardly toward the key 20, a combination of a reaction force by a mass or inertial load of the mass member 30 acting on the key 20 and a reaction force imparted to the key 20 by the actuator 40-3 becomes a reaction force applied to a finger of the human player performing depression operation of the key 20. Thus, the sixth embodiment of the keyboard apparatus 110-3 can create distributions of reaction forces similar to that of FIGS. 7A-7D created by the first embodiment and can perform force sense control on performance operation of the key 20.

The sixth embodiment of the keyboard apparatus 110-3, provided with the uni-directionally driven electromagnetic actuator 40-3, can be simplified in construction and can facilitate the driving control. Thus, the sixth embodiment of the keyboard apparatus 110-3 is suited for application to electronic keyboard instruments of simpler construction and inexpensive electronic keyboard instruments.

Seventh Embodiment

Figure 15:
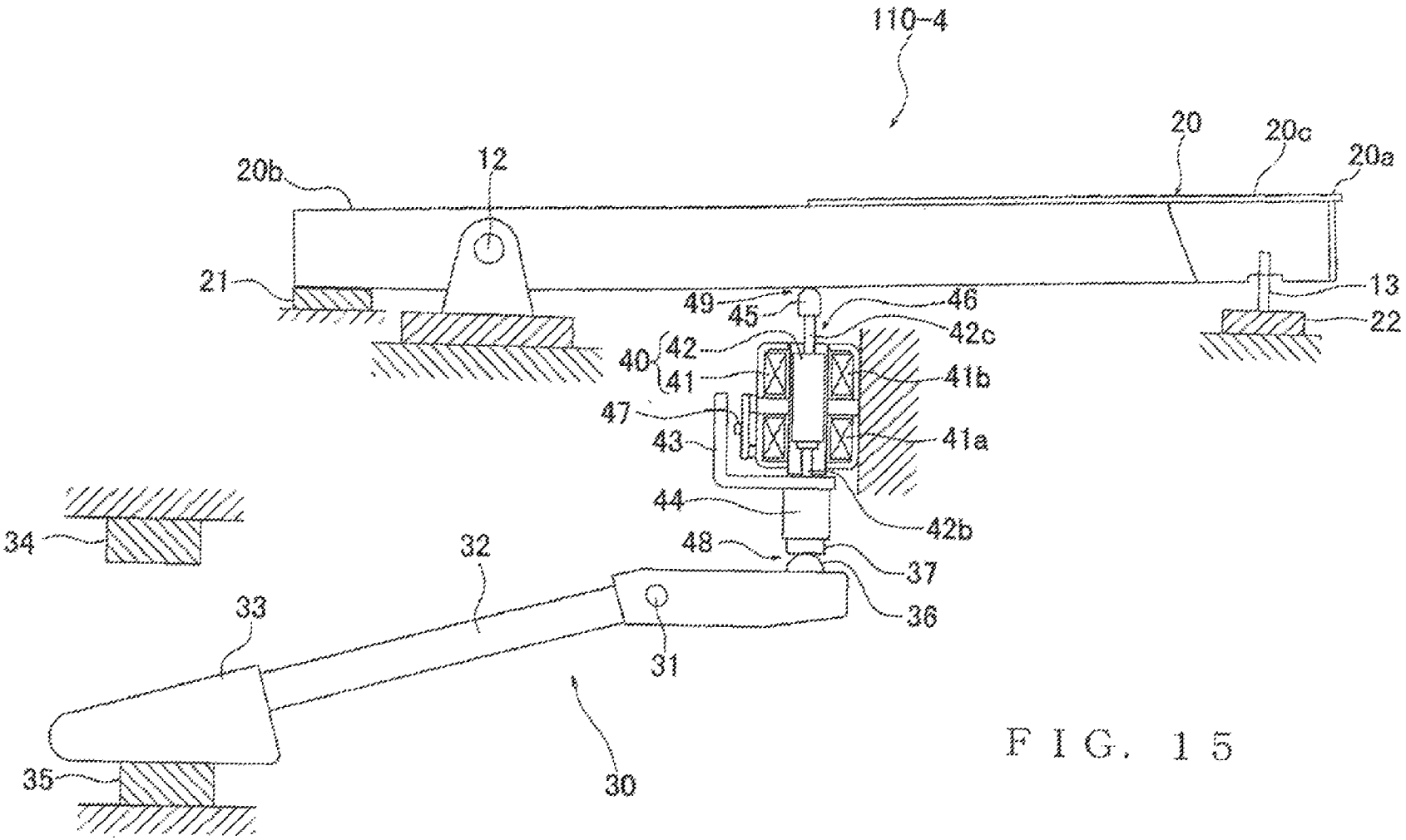
FIG. 15 is a view showing a construction of a seventh embodiment of the keyboard apparatus.

Next, a description will be given about a seventh embodiment of the keyboard apparatus of the present invention. FIG. 15 is a view showing a construction of the seventh embodiment of the keyboard apparatus 110-4. In the seventh embodiment of the keyboard apparatus 110-4, the vertical positional relationship between the key 20 and the mass member 30 is reversed from that in the fourth embodiment of the keyboard apparatus 110, and hence the orientation of the electromagnetic actuator 40 between the key 20 and the mass member 30 is also vertically reversed from that in the fourth embodiment of the keyboard apparatus 110. Also, the respective operating directions of the key 20, mass member 30 and electromagnetic actuator 40 are reversed from those in the fourth embodiment of the keyboard apparatus 110.

Namely, in the eleventh embodiment of the keyboard apparatus 110-4, the mass member 30 is disposed under the key 20, and the electromagnetic actuator 40 and the transmission member 46 are disposed between the lower surface of the key 20 and the mass member 30. In the transmission member 46, the upper end of the second rod 42*c* extending upward is held in abutment with a lower surface portion of the key 20 located forwardly of the key pivot point 12 (i.e., located on the same side as the key depression section 20*c*), and the lower end of the support member 44 fixed to the first rod 42*b* extending downward is held in abutment with an upper surface portion of the shank section 32 extending in an opposite direction from the mass member 33 with respect to the mass member pivot point 31.

Whereas the key 20, electromagnetic actuator 40 and transmission member 46 and mass member 30 in the fourth embodiment of the keyboard apparatus 110 are arranged from down to up in the order mentioned on a side (rear side) opposite from the key depression section 20*c* with respect to (i.e., as viewed from) the key pivot point 12, the key 20, electromagnetic actuator 40 and transmission member 46 and mass member 30 in the seventh embodiment of the keyboard apparatus 110-4 are arranged from up to down in the order mentioned on the same side as the key depression section 20*c* (i.e., on the front side).

In the seventh embodiment of the keyboard apparatus 110-4 too, when no depressing operation of the key 20 is being performed, the key 20 is held in the non-depressed position with the lower surface of the rear end region 20*b* of the key 20 held abutting against the upper key limit stopper 21 as shown in FIG. 15, because of both the balance between self-weights before and behind the key pivot point 12 and the load applied from the transmission member 46 to the key 20 via the transmission member 46. At that time, the mass member 30 is in its lower limit position abutting against the lower mass member limit stopper 35. Once the key 20 in the non-depressed position is depressed, the key 20 pivots about the key supporting position 12 while pushing downward the shank section 32 of the mass member 30 via the transmission member 46. In this manner, the key 20 pivots to the depressed position where the lower surface of the front end region 20*a* abuts against the lower key limit stopper 22. The mass member 30, having pivoted by being pushed downward by the key 20 via the plunger 42, is held in its upper limit position abutting against the upper mass member limit stopper 34 as long as the key 20 is in the depressed position. Then, once the key depressing force acting on the key 20 is removed, a load is applied from the mass member 30 to the key 20 via the transmission member 46, so that the key 20 returns to the non-depressed position because of both the applied load and the self-weight balance.

Eighth Embodiment

Figure 16:
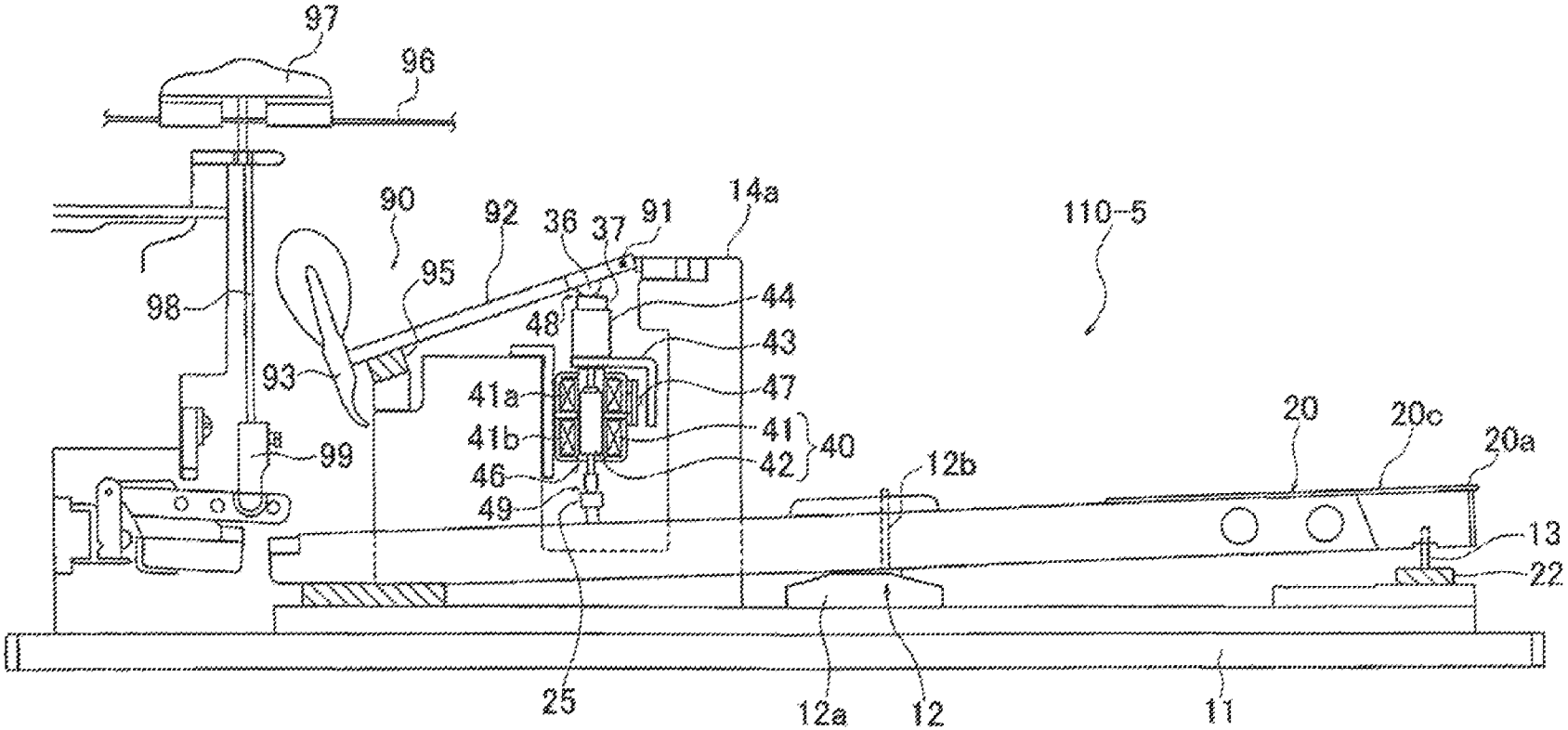
FIG. 16 is a view showing a construction of an eighth embodiment of the keyboard apparatus.

Next, a description will be given about an eighth embodiment of the keyboard apparatus of the present invention. FIG. 16 is a view showing a construction of the eighth embodiment of the keyboard apparatus 110-5. Whereas the mass member 30 provided in the fourth embodiment of the keyboard apparatus 110 only has the function of imparting an inertial force to operation of the key 20 and does not have the function of actually striking a string, a hammer (mass member) 90 provided in the eighth embodiment of the keyboard apparatus 110-5 has the function of actually striking a string to generate a tone as in an acoustic piano. Namely, the hammer 90 is similar in construction to a hammer provided in an acoustic piano, and it includes a shank section 92 of a straight rod shape extending from a hammer pivot point 91, provided at the upper end of the front wall 14*a* of the support section 14, and a string-striking section 93 provided at the distal end of the shank section 92 and having a predetermined mass. The shank section 92 is supported for pivoting movement about the hammer pivot point 91; more specifically, the shank section 32 is pivotable in a vertical plane lying orthogonal to the length of the key 20. The hammer 90 is angularly movable about the hammer pivot point 91 in the up-down direction over the rear end region of the key 20 with the shank section 32 functioning as a pivot arm.

A lower hammer limit stopper 95 for limiting pivoting movement of the hammer 90 is provided on the rear wall 14*b* of the support section 14. The lower hammer limit stopper 95 abuts the shank section 92 of the hammer 90 having pivoted to its lower limit position. A string 96 is struck by the string-striking section 93 having pivoted to its upper limit position. The keyboard apparatus 110-5 also includes a damper 97 for suppressing vibration of the string 96, a damper wire 98 for vertically moving the damper 97, a damper block 99, etc. Once the damper block 99 is lifted by the rear end of the key 20 having pivoted to the depressed position, the damper 97 is lifted via the damper wire 98 away from the string 96.

In this keyboard apparatus 110-5 too, the hammer 90 operates in interlocked relation to the key 20 via the transmission member 46 that is operatively connected to the hammer 90 via the magnet 37 and the bearing 361. Thus, the hammer 90 imparts a reaction force to performance operation of the key 20 in conjunction with the electromagnetic actuator 40. Further, in the keyboard apparatus 110-5, a tone is generated by the hammer 90 striking the string 96 in response to depression operation of the key 20. In this way, the keyboard apparatus 110-5 can, for example, dispense with a particular electronic tone generator for generating a tone in response to depression operation of the key 20, etc. Although not particularly shown, the keyboard apparatus 110-5 may include a stopper mechanism for holding the key 20 in the non-depressed position, so that the key 20 can be held in the non-depressed position as the transmission member 46 is driven by the electromagnetic actuator 40. Thus, the keyboard apparatus 110-5 can perform tone generation, based only on striking of the string 96, by driving only the hammer 90 with no load applied to the key 20. As a result, the eighth embodiment of the keyboard apparatus 110-5 can execute an automatic performance that comprises only performance tones involving no operation of the keys 20, with reduced energy and increased efficiency.

Further, in the eighth embodiment of the keyboard apparatus 110-5, where the hammer 90 and the transmission member 46 are operatively attached to each other through the attracting force of the magnet 37, it is possible to prevent the hammer 90 from bouncing back upon abutment against the lower hammer lower stopper 95, even without a component part corresponding to a backcheck member of an acoustic piano. Namely, with the hammer 90 and the transmission member 46 operatively attached to each other through the attracting force of the magnet 37, the eighth embodiment of the keyboard apparatus 110-5 can achieve an operational feeling (so-called pseudo backcheck operation) approximate to backcheck operation performed by a backcheck member immediately following a hammer abutting against a stopper in an action mechanism of an acoustic piano. As a result, the eighth embodiment of the keyboard apparatus 110-5 can even more faithfully reproduce an operational feeling of an acoustic piano while dispensing with a component part corresponding to a backcheck member of an acoustic piano and thereby simplifying the construction of the keyboard apparatus 110-5.

Whereas the embodiments according to the second aspect of the present invention have been described above, the present invention should not be construed as limited to the described embodiments and may be modified variously within the scope of the technical ideas set forth in the appended claims and the specification and drawings. For example, the shapes etc. of the magnet and attraction member provided in the keyboard apparatus may be modified as desired without being limited to those shown and set forth above.

Ninth Embodiment

Next, a ninth embodiment according to a third aspect of the present invention will be described with reference to FIGS. 17 to 23. Note that the ninth embodiment particularly concerns a novel force sense control scheme, and that any of the constructions of the keyboard apparatus shown in FIGS. 2 to 5 and FIGS. 10 to 16 may be applied as appropriate to the ninth embodiment. Hereinbelow, the ninth embodiment will be described assuming that the above-described keyboard apparatus construction of the first embodiment shown in FIGS. 2 to 5 is employed in the ninth embodiment.

Figure 17:
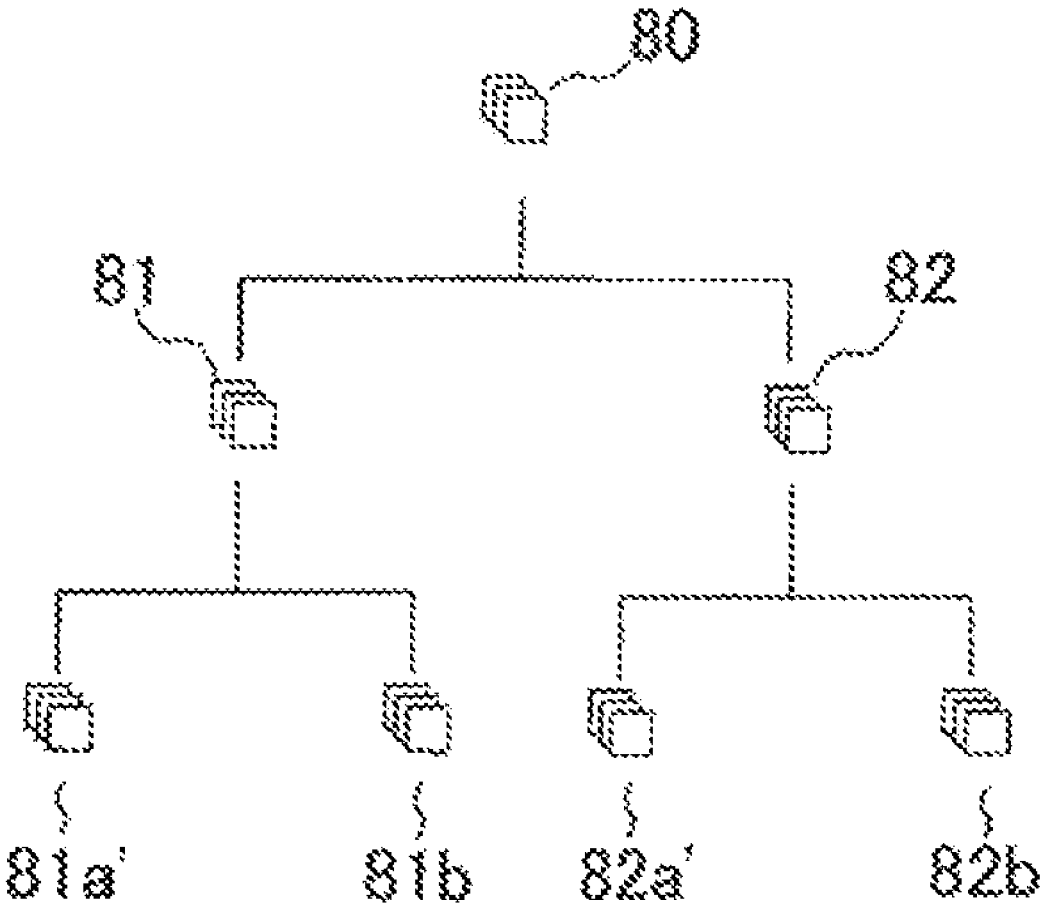
FIG. 17 is a diagram showing an example configuration of a force sense imparting table employed in a ninth embodiment of the keyboard apparatus.

FIG. 17 is a diagram showing an example configuration of the force sense imparting table 80 employed in the ninth embodiment. Although the force sense imparting table 80 may be the same table as shown in FIG. 6, the force sense imparting table 80 shown in FIG. 17 includes driving force pattern tables 81*a*' and 82*a*' in place of the reaction force pattern tables 81*a* and 82*a*. Namely, the force sense imparting table 80 shown in FIG. 17 includes the key depressing table 81 and key releasing table 82, each of which includes the driving force pattern table 81*a*' or 82*a*' containing patterns of driving forces to be generated and the instruction value table 81*b* or 82*b* containing instruction values for generating the driving forces.

Figure 18:
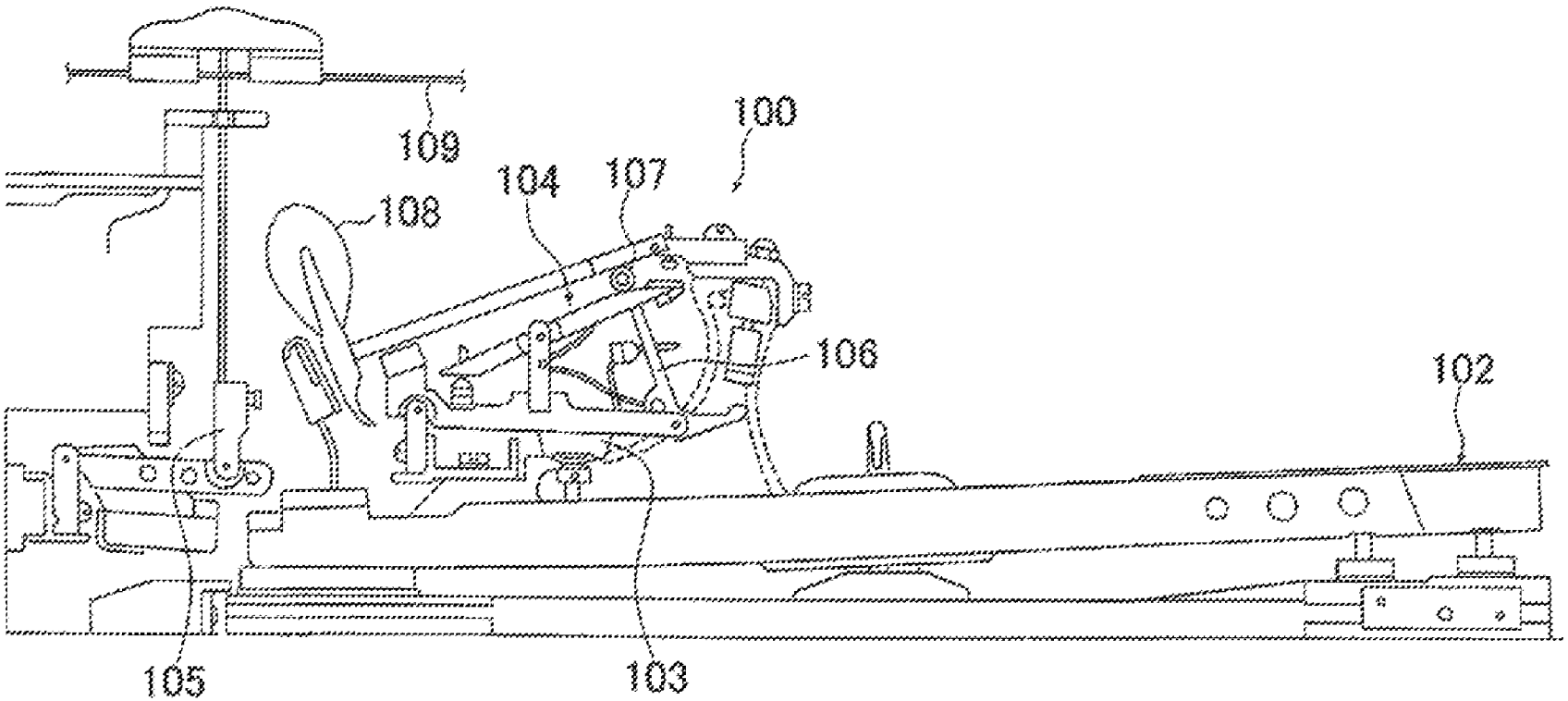
FIG. 18 is a view showing an action mechanism of an acoustic piano.

Now, prior to detailed description of the force sense control on the key 20, behavior of an action mechanism of an acoustic piano will be outlined. FIG. 18 is an external overview of an action mechanism 100 of an acoustic piano. In the action mechanism 100 shown in FIG. 18, once a key 102 is depressed, an action 104 stars to be lifted via a capstan 103. Then, a damper 105 starts to be pushed upward by the rear end of the key 102. After the action 104 has been lifted, a jack 106 pushes up a hammer roller 107, so that a hammer 108 starts pivoting toward a string 109. Then, as the key 102 is further depressed, the jack 106 further pushes up the hammer roller 107 and then disengages (escapes) from the hammer roller 107, so that the hammer 108 strikes the string 109. After having struck the string 109, the hammer 108 falls down due to a reaction force from the string 109 and self-weight of the hammer 108. Then, once the key 102 is released from the depressing force to go into a key release stroke, the rear end of the key 102 gradually depresses the damper 105 and then disengages from the damper 105, after which the key 102 returns its rest position. In the aforementioned manner, a series of actions of the action mechanism is completed.

Figure 19:
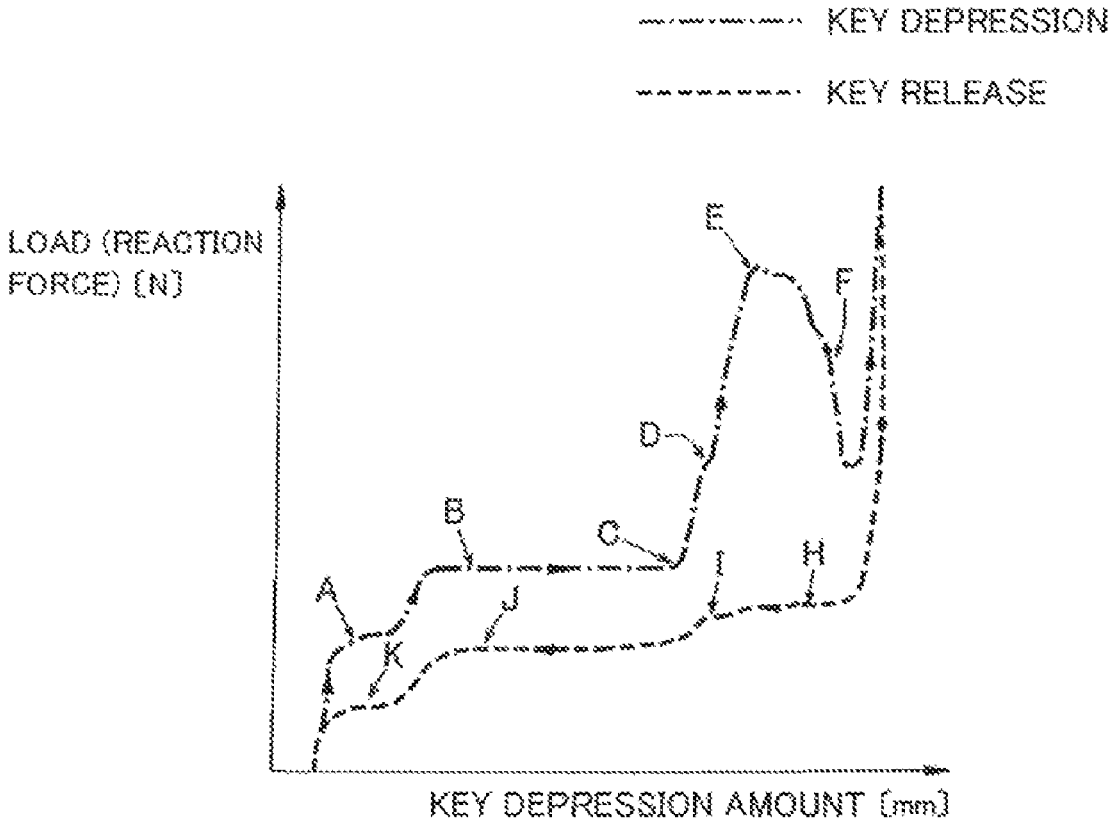
FIG. 19 is a graph showing a characteristic of a reaction force (static reaction force) to operation of a key in an acoustic piano.

FIG. 19 is a graph showing characteristics of reaction forces (static reaction forces) in a case where the key 102 is gently depressed and returned to its initial position (rest position) after having been fully depressed. In FIG. 19, the horizontal axis represents a key depression amount, while the vertical axis represents a load (reaction force) to the key. Note that no consideration is given here about static reaction forces produced while the damper 105 is in a lifted position with a damper pedal (not shown) depressed (i.e., while no reaction force of the damper 105 is being applied to the key 102).

In a key depression stroke, as depicted by one-dot-dash line in the graph of FIG. 19, point A, immediately following the start of the depression of the key 102, is where static loads of the key 102, action 104, etc. are added, and point B is where a load of the damper 105 is added. Point C is where action loads due to friction forces etc. of various portions of the action mechanism 100 start to be applied, point D is where the jack 106 has started to escape from the hammer roller 107, and point F is where the jack 106 has completely escaped from the hammer roller 107. String striking point is located at a predetermined position, such as point E, between point E and point F. In the case of key depression of a medium intensity level or greater, the reaction force suddenly decreases at point F where the hammer 108 pivots to strike the string 109, and then a great reaction force is produced once the key 102 reaches an end position because the key 102 abuts against a key bed.

In the key release stroke, as depicted by a broken line in FIG. 19, the key 102 returns to the initial position by way of point H where a load produced as the jack 106 returns to its initial position (i.e., returning jack load) is imparted, point I where action loads due to friction forces etc. of the various portions of the action mechanism 100 are applied, point J where a load of the damper 105 is applied and point K where the static loads of the key 102, action 104, etc. are added. In the aforementioned manner, the key 102 of the acoustic piano applies, to a finger of a human player, a reaction force that varies variously depending on a changing position of the key 102 because of the motions of the action mechanism 100 and self-weights of the various component parts of the action mechanism 100.

The instant embodiment of the keyboard apparatus 10 (which may be constructed in the manner shown in FIGS. 2 to 5) is arranged to impart reaction force characteristics, corresponding to a key touch feeling of an acoustic piano, by driving the plunger 42 via the electromagnetic actuator 40 during performance on the electronic keyboard instrument 1, with a view to reproducing a key touch feeling (resistance feeling) that is characteristic of an acoustic piano and felt by the finger of the human player on the basis of behavior of the action mechanism 100. The reaction force characteristics vary from moment to moment depending on a changing position and velocity of the key 20 in the key depressing or releasing direction. Thus, in performing the aforementioned force sense control, a driving force is imparted to the actuator 40 in accordance with position information of the key 20 based on a detection value of the position sensor 47.

Namely, detection data is output from the position sensor 47 to the main control section 50, as shown in FIG. 5. The main control section 50 issues an instruction to the control driver 58 and PWM switching circuit 59, with reference to the force sense imparting table 80 stored in the ROM 52. On the basis of the instruction from the main control section 50, the control driver 58 and PWM switching circuit 59 supplies a driving current to the projecting coil 41*a* or retracting coil 41*b* of the actuator 40. In this manner, a driving force for driving the transmission member 46 toward the mass member 30 or key 20 is given to the transmission member 46, through driving of the projecting coil 41*a* or retracting coil 41*b*.

Figure 21A:
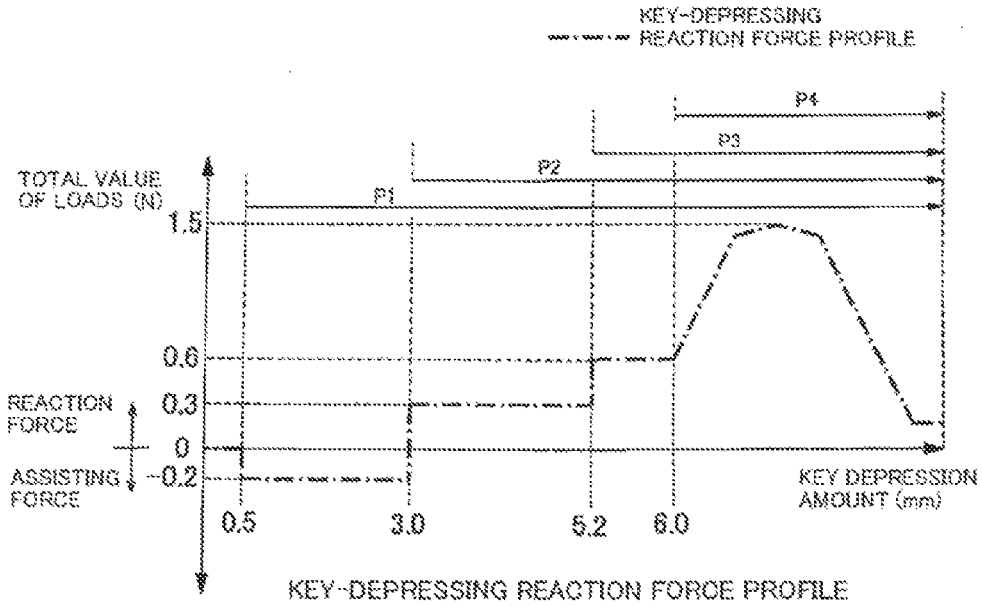
Figure 21B:
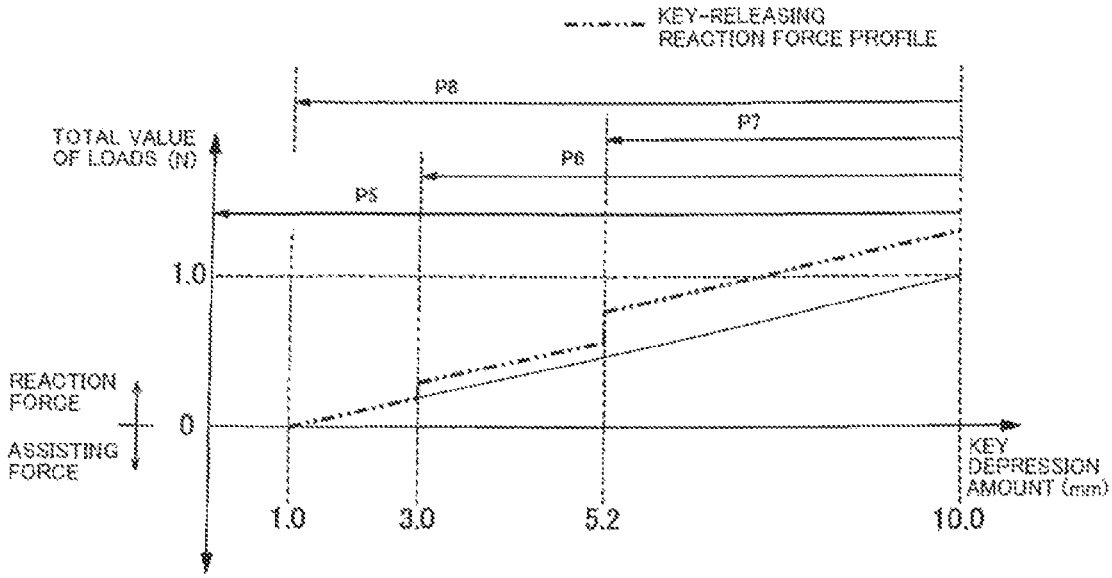
Figure 22:
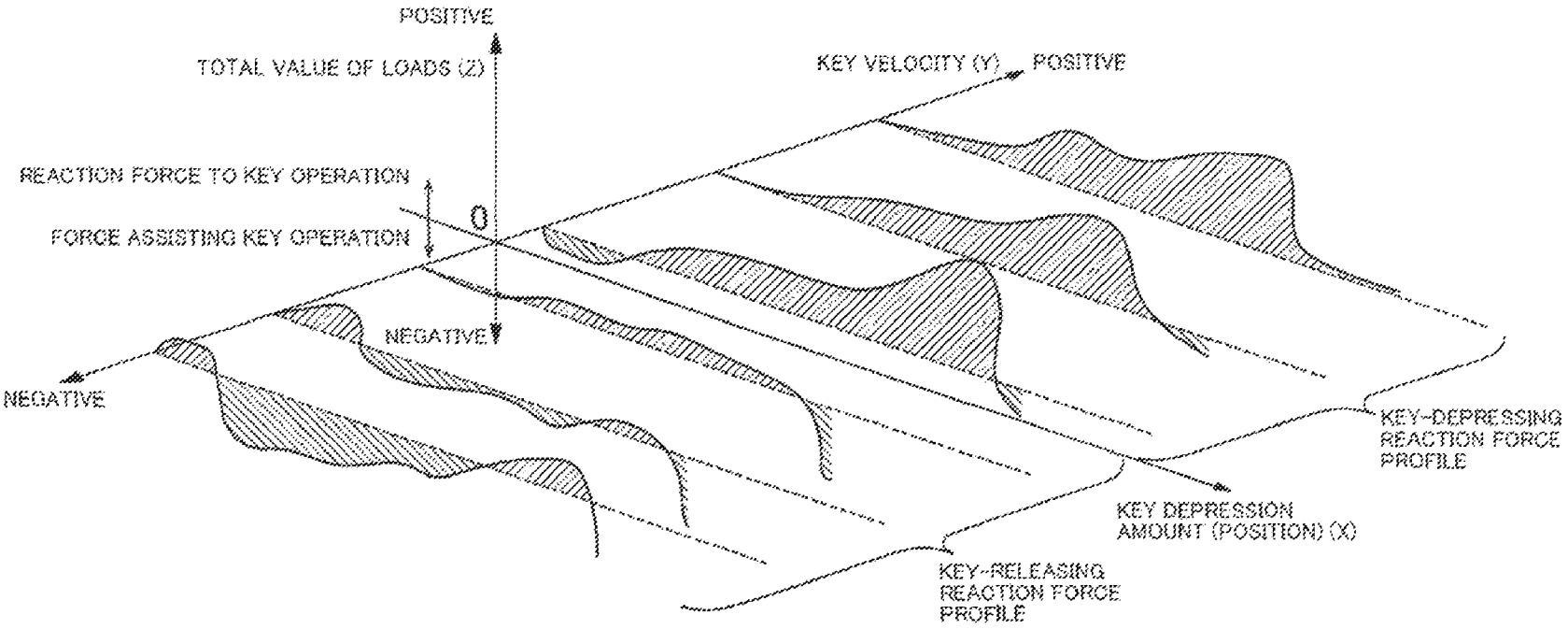
FIG. 22 is a graph showing an example distribution of reaction force profiles responsive to a velocity of the key.

FIGS. 20A and 20B show specific contents of the instruction value tables 81*b* and 82*b* included in the force sense imparting table 80 shown in FIG. 17 or 6. More specifically, FIG. 20A is a table explanatory of the instruction value table 81*b* of the key depressing table 81, while FIG. 20B is a table explanatory of the instruction value table 82*b* of the key releasing table 82. Further, FIGS. 21A and 21B are graphs showing reaction force profiles based on the instruction value tables 81*b* and 82*b*. More specifically, FIG. 21A shows a key-depressing reaction force profile based on the instruction value table 81*b*, while FIG. 21B shows a key-releasing reaction force profile based on the instruction value table 82*b*. In the graphs of FIGS. 21A and 21B, the horizontal axis represents a key depression amount (i.e., amount of movement of the key 20 from the non-depressed position), while the vertical axis represents a total value of loads acting from the electromagnetic actuator 40 on the key 20. Further, FIG. 22 is a graph showing an example distribution of reaction force profiles responsive to the depression amount and velocity of the key 20, where the X axis represents the depression amount (position) of the key 20, the Y axis represents the velocity of the key 20 and the Z axis represents the total value of the loads generated by the electromagnetic actuator 40. In each of the graphs of FIGS. 21 and 22, if the total value of the loads generated by the electromagnetic actuator 40 is a positive value, it means that the driving force acts in such a direction as to promote or increase the reaction force imparted from the mass member 30 to depression operation of the key 20 (i.e., reaction force against the operation of the key). If, on the other hand, the total value of the loads generated by the electromagnetic actuator 40 is a negative value, it means that the driving force acts in such a direction as to decrease the reaction force imparted from the mass member 30 to depression operation of the key 20 (i.e., the driving force assists the operation of the key).

The following describe in detail the instruction value tables 81*b* and 82*b* of FIGS. 20A and 20B and the reaction force profiles of FIGS. 21A and 21B generated on the basis of the instruction value tables 81*b* and 82*b*. First, a description will be given about the instruction value table 81*b* of FIG. 20A and key-depressing reaction force profile of FIG. 21A. The load imparted from the electromagnetic actuator 40 to the key 20 in response to depression of the key 20 comprises four kinds of loads: a first key-depression load P1 imparted at and after an initial key depression stage immediately following the start of the depression of the key 20; second and third key-depression loads P2 and P3 sequentially imparted in the middle of the depression of the key 20; and a fourth key-depression load P4 that starts to be imparted near the end of the depression of the key 20. Thus, the load imparted from the electromagnetic actuator 40 to the key 20 during the key depression is a sum of some of the aforementioned four kinds of key-depression loads which are generated depending on a changing position of the depressed key 20. The following describe the four kinds of key-depression loads.

The first key-depression load P1 is a load for reproducing a static load required for lifting, at the initial stage of depression of the key 102, the key 102 and hammer 108 from their rest positions according to the reaction force characteristics of the acoustic piano provided with the action mechanism 100 of FIG. 18; this is a load for adjusting the inertial force to be imparted from the mass member 30. More specifically, the instruction value of the first key-depression load P1 is a constant value that does not depend on the key depressing velocity. In the illustrated example, the key depression amount at a start position of the first key-depression load P1 is "0.5 mm" and the instruction value of the first key-depression load P1 is "−0.2 N". Namely, in the illustrated example, the instruction value of the first key-depression load P1 is a negative value. Thus, in a region from the position of the key depression amount "0.5 mm" where impartment of the first key-depression load P1 is started to the position of the key depression amount "3.0 mm" where impartment of the second key-depression load P2 is started, the electromagnetic actuator 40 imparts a driving force in such a direction as to decrease the reaction force imparted from the mass member 30 to the key 20 (i.e., imparts a driving force assisting the operation of the key 20).

Because the mechanical construction for driving the key 20 in the instant embodiment of the keyboard apparatus 10 greatly differs from that in the action mechanism 100 of the acoustic piano, a reaction force when no driving force is being generated (i.e., reaction force against key depression/release operation based only on a mechanical structure of the key 20, mass member 30, etc.) differs from that in the acoustic piano. Thus, at the initial stage of key depression from a depression start time when the key 20 starts moving in response depression operation to a time when a predetermined key depression amount is reached, the value of inertial loads applied from the mass member 30 etc. are greater than that in the acoustic piano. Therefore, in the instant embodiment of the keyboard apparatus 10, a driving force is imparted, at the initial stage of key depression, in accordance with the first key-depression load P1 in such a direction as to decrease the reaction force imparted from the mass member 30 to the key 20, so that the key 20 can be operated with a less force; in this way, the instant embodiment can correct a difference in key touch feeling between the keyboard apparatus 10 and a natural keyboard instrument.

The second key-depression load P2 is a load for reproducing a load applied to the key 102 when lifting, by the key 102, of the damper 105 is started via the action mechanism 100 in the acoustic piano. In the illustrated example, the instruction value of the second key-depression load P2 is a constant value that does not depend on the key depressing velocity, and the key depression amount at a start position of the second key-depression load P2 is "3.0 mm" and the instruction value of the second key-depression load P2 is "+0.5 N".

The third key-depression load P3 is a load for reproducing a load applied to the key 102 by the various component parts of the action mechanism 100 operating in the middle of depression of the key 102. In the illustrated example, the instruction value of the third key-depression load P3 is a constant value that does not depend on the key depressing velocity, and the key depression amount at a start position of the third key-depression load P3 is "5.2 mm" and the instruction value of the third key-depression load P3 is "+0.3 N".

The fourth key-depression load P4 is a load for reproducing a sudden change in the load applied to the key 102 which is caused by the jack 106 escaping from the hammer roller 107 in the action mechanism 100 of the acoustic piano. The fourth key-depression load P4 has a distribution of reaction forces that depends on the key depressing velocity. In the specific example of FIG. 21A, the fourth key-depression load P4 has a mountain-shaped distribution involving rapid and great increase and decrease of the reaction forces. In the illustrated example, the key depression amount at a start position of the fourth key-depression load P4 is "6 mm", the instruction value of the fourth key-depression load P4 is "+0.9 N", and the maximum total load value is "1.5 N". With the key-depressing instruction value table 81*b* of the aforementioned contents, there can be generated the key-depressing reaction force profile of FIG. 21A.

Next, a description will be given about the key-releasing instruction value table 82*b* shown in FIG. 20B and key-releasing reaction force profile of FIG. 22B. The load imparted from the electromagnetic actuator 40 to the key 20 in response to release of the key 20 comprises four kinds of loads: a first key-release load P5 imparted from the start to end of the release of the key 20; and second, third and fourth key-release loads P6, P7 and P8 whose impartment ends sequentially in the middle of the release of the key 20. Thus, the load imparted from the electromagnetic actuator 40 to the key 20 during the key release too is a sum of some of the aforementioned four kinds of key-release loads which are generated depending on a changing position of the released key 20. The following describe the four kinds of key-release loads.

The first key-release load P5 is a load for adjusting the static load applied to the key 20 during the key release. In the key depression amount at an end position of the first key-release load P5 is "0 mm" and the instruction value of the first key-release load P5 is "0 N". Namely, in the illustrated example, no load for adjusting the static load is substantively imparted during the key release, so that the reaction force applied to the key 20 consists of (or is covered by) only the load of the mass member 30 near the end of the key release. The second key-release load P6 is a load for reproducing a load applied to the key 102 by lifting of the damper 105 in the acoustic piano. In the illustrated example, the key depression amount at an end position of the second key-release load P6 is "3.0 mm" and the instruction value of the second key-release load P6 is "0.5 N". The third key-release load P7 is a load for reproducing a load applied to the key 102 by the action mechanism 100 during the release of the key 102. In the illustrated example, the key depression amount at an end position of the third key-release load P7 is "5.2 mm" and the instruction value of the third key-release load P7 is "0.3 N".

The fourth key-release load P8 is a load that is unique to the electronic keyboard instrument 1 and necessary for returning the key 20 to the initial position; namely, the fourth key-release load P8 among the kinds of loads generated in the action mechanism 100 of the acoustic piano. The fourth key-release load P8 has a distribution of reaction forces that depends on the key releasing velocity. In the illustrated example, the key depression amount at an end position of the fourth key-release load P8 is "1 mm" and the maximum instruction value of the fourth key-release load P8 is "1 N".

It should be appreciated that the instruction value tables 81*b* and 82*b* of FIGS. 20A and 20B and the reaction force profiles of FIGS. 21A and 21B are just illustrative examples. In practice, a plurality of different kinds of key-depressing reaction force profiles and a plurality of different kinds of key-releasing reaction force profiles are generated, as shown in FIG. 22, in accordance with instruction value tables that define instruction values corresponding to various velocity values of the key 20. Namely, when the velocity of the key 20 is in a positive value range, it means that the key 20 is moving in the key depressing direction, so that a plurality of kinds of key-depressing reaction force profiles corresponding to velocity values (absolute values) of the velocity of the key 20 are generated as shown in the graph of FIG. 22. When the velocity of the key 20 is in a negative value range, on the other hand, it means that the key 20 is moving in the key releasing direction, so that a plurality of kinds of key-releasing reaction force profiles corresponding to velocity values (absolute values) of the velocity of the key 20 are generated as shown in the graph of FIG. 22. Further, the specific instruction values contained in the instruction value tables 81*b* and 82*b* are just illustrative examples, and these values differ depending on various factors, such as masses of the key 20 and mass member 30.

Figure 23:
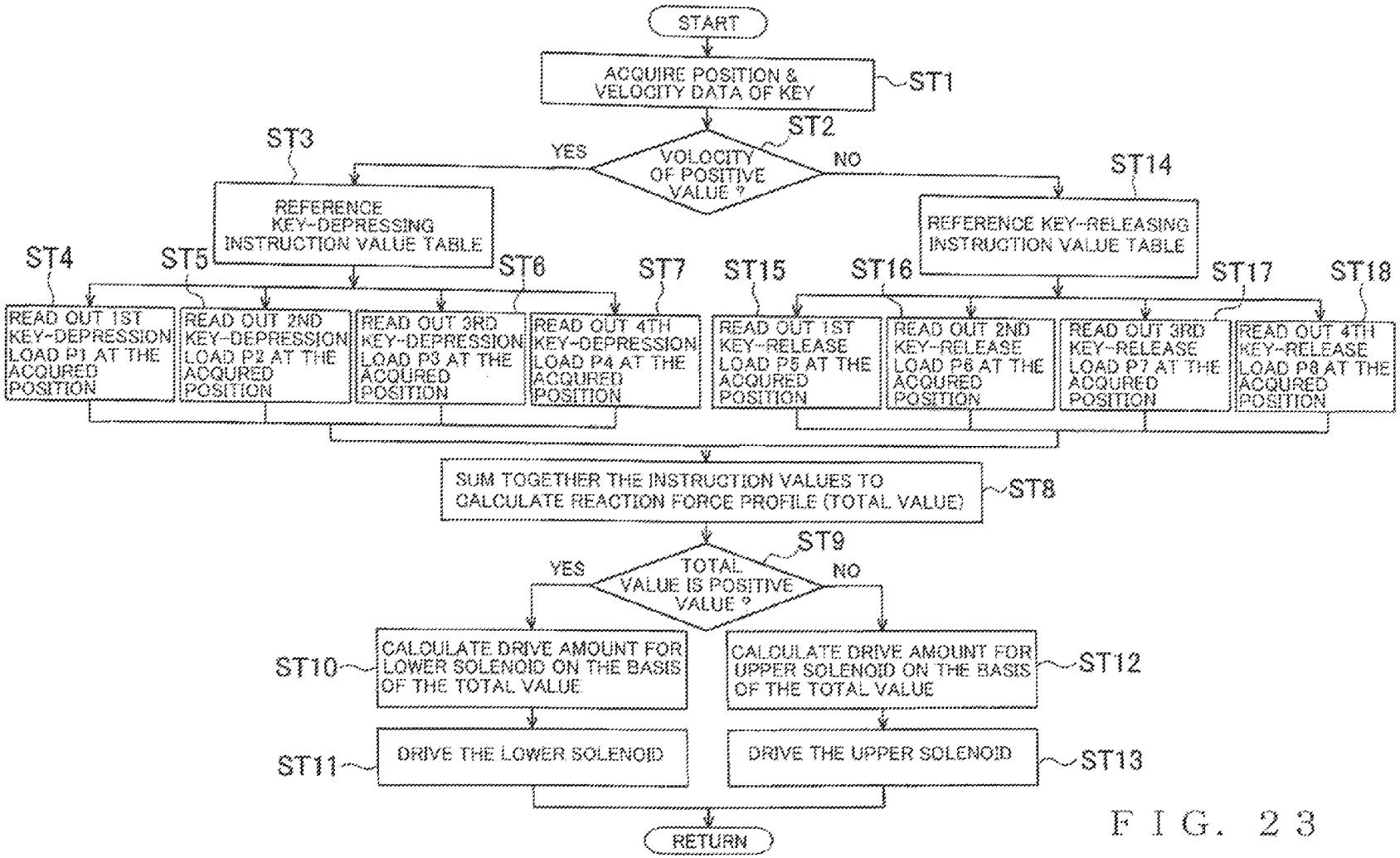
FIG. 23 is a flow chart showing an example operational sequence of force sense control performed on key depression/release operation.

The following describe an example operational sequence of the force sense control performed in the instant embodiment on key depression/release operation, with reference to a flow chart of FIG. 23. First, at step ST1, position data and velocity data pertaining to the key 20 are acquired on the basis of the detection by the position sensor 47. Note that the velocity data may be calculated on the basis of a change amount of the position data detected by the sensor 47 or, if a separate velocity sensor is provided in the instant embodiment, may be velocity data detected by the velocity sensor. Then, at step ST2, a determination is made as to whether or not the acquired velocity data is of a positive value. If the acquired velocity data is of a positive value as determined at step ST2 (YES determination at step ST2), the key-depressing instruction value table 81*b* shown in FIG. 20A is referenced at step ST3. Then, instruction values of the first key-depression load P1, second key-depression load P2, third key-depression load P3 and fourth key-depression load P4 at the acquired (or detected) position of the key 20 are read out from the key-depressing instruction value table 81*b* at steps ST4, ST5, ST6 and ST7, respectively. Note that instruction values of all of the first to fourth key-depression loads P1 to P4 do not necessarily exist for the acquired position; namely, instruction values of only some of the first to fourth key-depression load P1 to P4 exist depending on the acquired position of the key 20. Then, at step ST8, the instruction values of all or some of the first to fourth key-depression loads P1 to P4 (which exist for the acquired position of the key 20) are summed together to calculate a total value of loads (reaction force of the reaction force profile shown in FIG. 21A). Next, a determination is made, at step ST9, as to whether the calculated total value of loads is a positive value. If the calculated total value of loads is a positive value (YES determination at step ST9), a drive amount of the returning coil (or lower solenoid) 41*b* is calculated on the basis of the calculated total value of loads at step ST10, and the returning coil (or lower solenoid) 41*b* is driven in accordance with the calculated drive amount at step ST11. If, on the other hand, the calculated total value of loads is a negative value (NO determination at step ST9), a drive amount of the projecting coil (or upper solenoid) 41*a* is calculated on the basis of the calculated total value of loads at step ST11, and the projecting coil (or upper solenoid) 41*a* is driven in accordance with the calculated drive amount at step ST13.

If the acquired velocity data is of a negative value as determined at step ST2 (NO determination at step ST2), the key-releasing instruction value table 82*b* shown in FIG. 20B is referenced at step ST14. Then, instruction values of the first key-release load P5, second key-release load P6, third key-release load P7 and fourth key-release load P8 at the acquired (or detected) position of the key 20 are read out from the key-releasing instruction value table 82 at steps ST15, ST16, ST17 and ST18, respectively. Then, at step ST8, the instruction values of the first to fourth key-releasing loads P5 to P8 are summed together to calculate a total value of loads (reaction force of the reaction force profile shown in FIG. 21B). Next, a determination is made, at step ST9, as to whether the calculated total value of loads is a positive value. If the calculated total value of loads is a positive value (YES determination at step ST9), a drive amount of the returning coil (or lower solenoid) 41*b* is calculated on the basis of the calculated total value of loads at step ST10, and the returning coil (or lower solenoid) 41*b* is driven in accordance with the calculated drive amount at step ST11. If, on the other hand, the calculated total value of loads is a negative value (NO determination at step ST9), a drive amount of the projecting coil (or upper solenoid) 41*a* is calculated on the basis of the calculated total value of loads at step ST11, and the projecting coil (or upper solenoid) 41*a* is driven in accordance with the calculated drive amount at step ST13.

Figure 24A:
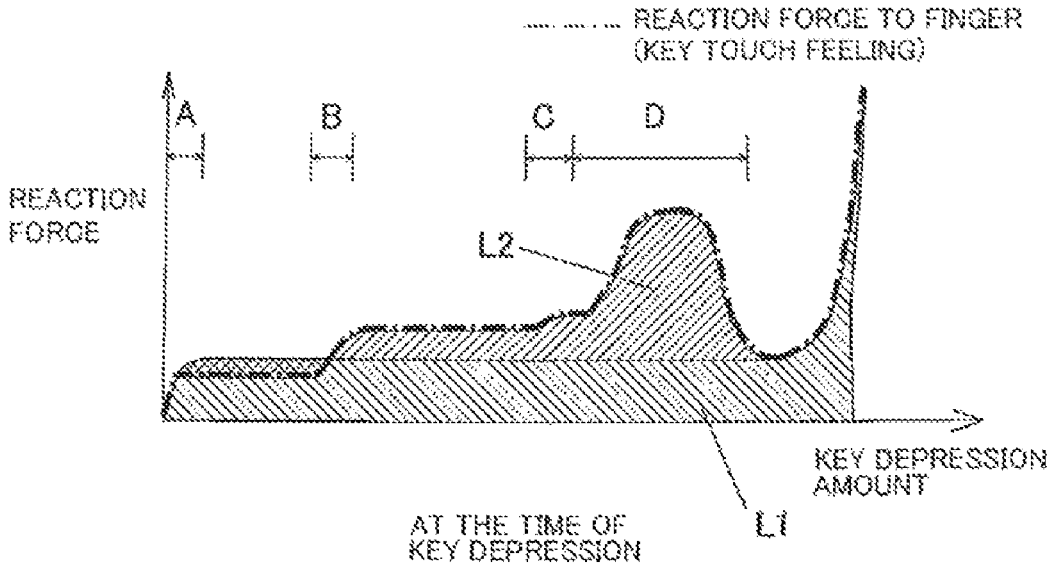
Figure 24B:
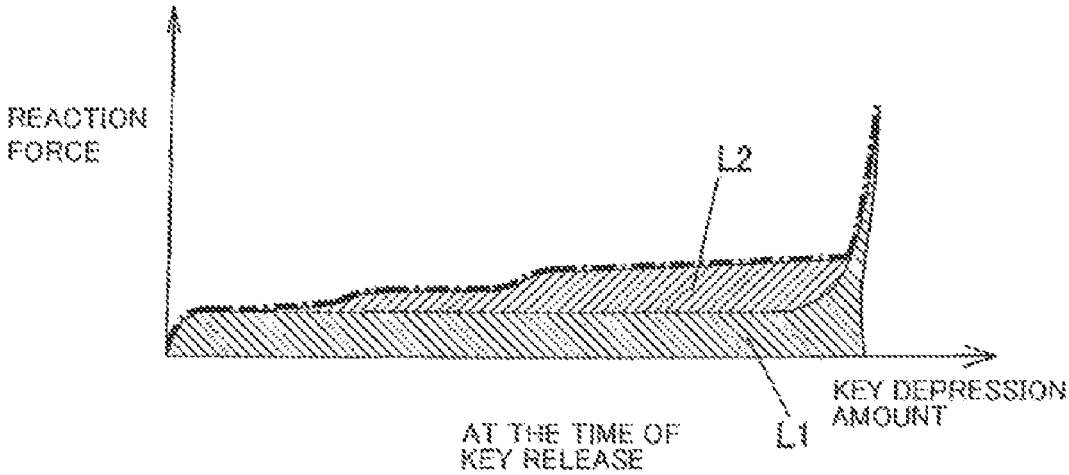

FIGS. 24A and 24B are graphs showing relationship between a displacement (depression amount) of the key 20 and a reaction force applied from the key 20 to a human player's finger depressing the key 20 in the case where the force sense control has been performed in the aforementioned manner, of which FIG. 24A shows a distribution of reaction forces when the key 20 has been depressed relatively slowly while FIG. 24B shows a distribution of reaction forces when the key 20 has been released relatively slowly. With the force sense control on the key 20 in the instant embodiment of the keyboard apparatus 10, the reaction force applied from the key 20 to the human player's finger depressing the key 20 is a sum of a reaction force L1 caused by the mass or inertial load acting on the key 20 and a reaction force L2 imparted to the key 20 by the electromagnetic actuator 40 (see one-dot-dash line in FIG. 24). This distribution of reaction forces (one-dot-dash line in FIG. 24) can be said to be a reproduction of a distribution of reaction forces in an acoustic piano.

The following describe in greater detail the distributions of reaction forces to operation of the key 20. In this case, the reaction forces applied to the human player's finger depressing the key 20 exhibit a distribution starting at an initial value (zero load) corresponding to a zero key depression amount and including changes in four regions A, B, C and D, in generally the same manner as shown in FIG. 7A. Detailed description of the regions A, B, C and D is omitted here because the foregoing description made with reference to FIG. 7A is applicable here too.

In this case, the reaction force L2 to be imparted to the key 20 by the electromagnetic actuator 40 at the initial stage of depression of the key 20 is of a negative value because the first key-depression load P1 is of a negative value (see FIG. 24A). Thus, the reaction force applied to the human player's finger at the initial stage of depression (one-dot-dash line) is smaller in value than the reaction force L1 applied from the mass member 30 to the key 20. Namely, in the instant embodiment of the keyboard apparatus 10, a driving force is imparted in such a direction as to decrease the reaction force L1 so that a correction can be made to decrease the reaction force L1 caused by the inertial load of the mass member 30. In this way, the instant embodiment can effectively correct a difference in key touch feeling between the keyboard apparatus 10 and a natural keyboard instrument.

At the time of release of the key 20 shown in FIG. 24B, there occurs no reaction force corresponding to an escape, from the hammer roller, of the jack in region D; otherwise, the distribution of reaction forces at the time of the release of the key 20 is similar to the distribution of reaction forces at the time of the depression of the key 20. In this case too, the instant embodiment can reproduce a distribution of reaction forces in an acoustic piano. Namely, a distribution of reaction forces applied to a human player's finger in response to depression of a key in an acoustic piano, including the complicated action mechanism 100, as shown in FIG. 18 can be faithfully reproduced by a combination of the reaction force L1 by the mass member 30 and the reaction force L2 created by the electromagnetic actuator 40.

As set forth above, the instant embodiment of the keyboard apparatus 10 according to the third aspect of the present invention is constructed in such a manner that instruction values of loads to be imparted to the key 20 by means of the bi-directionally driven electromagnetic actuator 40 are determined on the basis of information pertaining to a position of the key 20 acquired by the position sensor 47 and a velocity of the key 20 calculated on the basis of a change in the position, and that the electromagnetic actuator 40 selectively generates, as a driving force corresponding to the determined instruction values, any one of a driving force acting in such a direction as to promote or increase the reaction force imparted from the mass member 30 to depression operation of the key 20 (i.e., reaction force against the operation of the key) and a driving force acting in such a direction as to decrease the reaction force imparted from the mass member 30 to depression operation of the key 20 (i.e., force assisting the operation of the key). With the force sense control on the key 20 through the driving of the electromagnetic actuator 40, the instant embodiment of the keyboard apparatus 10 can appropriately adjust the reaction force to performance operation of the key 20 and thereby achieve a key touch feeling more approximate to that of a natural keyboard instrument. As a result, the instant embodiment of the keyboard apparatus 10 can faithfully reproduce a reaction force to performance operation of a natural keyboard instrument, such as an acoustic piano, including a complicated action mechanism.

Namely, in the instant embodiment of the keyboard apparatus 10 which is designed to simulate a key touch feeling of a natural keyboard instrument by the electromagnetic actuator 40 generating an auxiliary or assisting driving force, a reaction force to key depression operation based only on the mechanical structure consisting of the key 20, mass member 30, etc. (i.e., reaction force when no driving force is being generated by the electromagnetic actuator 40) would differ from a reaction force generated in a natural keyboard instrument, such as an acoustic piano. Consequently, at the initial stage of depression of the key 20, from the depression start time when the key 20 starts moving in response depression operation to the time when a predetermined key depression amount is reached, the inertial load (L1) applied from the mass member 30 to the key 20 would take a great value as compared to the natural keyboard instrument, as set forth above. However, in the instant embodiment of the keyboard apparatus 10, the bi-directionally-driven electromagnetic actuator 40 is provided for driving the transmission member 46 upwardly (away from the key 20) to thereby impart a driving force acting in such a direction as to decrease the reaction force imparted from the mass member 30 to depression operation of the key 20 (i.e., driving force assisting the operation of the key). Thus, the instant embodiment of the keyboard apparatus 10 can effectively correct a difference in key touch feeling at the initial stage of depression of the key between the keyboard apparatus 10 and the natural keyboard instrument.

The ninth embodiment of the keyboard apparatus 10 according to the third aspect of the present invention has been described as applied to the electronic keyboard instrument 1 including an electronic tone generator that generates a tone in response to operation of the key 20. Thus, in the ninth embodiment of the keyboard apparatus 10, the mass member 30 does not have the function of actually striking a string and has only the function of merely imparting an inertial mass to the key 20 to realize a key touch feeling approximate to that in a natural keyboard instrument, such as an acoustic piano. However, it should be appreciated that the keyboard apparatus of the present invention is not limited to the above-described construction and may have the function of causing a tone to be generated by the mass member actually striking a string. In such a case, a mechanism for causing an electronic tone in response to operation of the key may be dispensed with.

Further, whereas, in the above-described embodiments according to the first to third aspects, the mass member 30 is constructed to pivot about the mass member pivot point 31, the movement of the mass member 30 provided in the keyboard apparatus of the present invention is not limited to such pivoting movement and may be linear or any other type of movement. Furthermore, the positional relationship between the key, the transmission member and the mass member is not limited to the vertical positional relationship as shown and described in relation to the embodiments. For example, although not particularly shown, the key and the mass member may be arranged side by side in the horizontal direction with the transmission member interposed therebetween, so that the movement of the key can be transmitted in the horizontal direction to the mass member via the transmission member. In such a case, the mass member may be constructed to either pivot or linearly move.

While the present invention has been particularly shown and described with reference to preferred embodiment thereof, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention accordingly is to be defined as set forth in the appended claims.

This application is based on, and claims priorities to, JP PA 2009-151649 filed on 25 Jun. 2009, JP PA 2009-151650 filed on 25 Jun. 2009, and JP PA 2009-194675 filed on 25 Aug. 2009. The disclosures of the priority applications, in their entirety, including the drawings, claims, and the specifications thereof, are incorporated herein by reference.

What is claimed is:

1. A keyboard apparatus comprising:

a key supported for pivoting movement about a key pivot point;

a mass member that imparts a reaction force to performance operation of the key in interlocked relation to movement of the key;

a transmission member provided in abutment with both of the key and the mass member to transmit a load from one of the key or the mass member to the other of the key or the mass member;

an electromagnetic actuator including a fixed coil and that drives, via the coil, the transmission member toward at least one of the key or the mass member; and a control section that controls driving of the transmission member by the electromagnetic actuator, wherein the electromagnetic actuator is positioned between the mass member and the key.

2. The keyboard apparatus as claimed in claim 1, wherein:

the mass member includes a mass section and an arm section that supports the mass section for angular movement in a region over the key, and the transmission member is provided in abutment with a portion of the key located on an opposite side from a key depression section of the key with respect to the key pivot point and in abutment with the arm section of the mass member.

3. The keyboard apparatus as claimed in claim 1, wherein:

the mass member includes a mass section and an arm section that supports the mass section for angular movement in a region under the key, and the transmission member is provided in abutment with a portion of the key located on a same side as a key depression section of the key with respect to the key pivot point and in abutment with the arm section of the mass member.

4. The keyboard apparatus as claimed in claim 1, further comprising:

at least one operation detection section that detects operation of at least one of the transmission member, the key, or the mass member, wherein the control section controls, on the basis of a detection result of the operation detection section, a driving force to be generated by the electromagnetic actuator.

5. The keyboard apparatus as claimed in claim 2, further comprising:

at least one operation detection section that detects operation of at least one of the transmission member, the key, or the mass member, wherein the control section controls, on the basis of a detection result of the operation detection section, a driving force to be generated by the electromagnetic actuator.

6. The keyboard apparatus as claimed in claim 3, further comprising:

at least one operation detection section that detects operation of at least one of the transmission member, the key, or the mass member, wherein the control section controls, on the basis of a detection result of the operation detection section, a driving force to be generated by the electromagnetic actuator.

7. The keyboard apparatus as claimed in claim 1, wherein:

the control section includes a storage device storing a force sense imparting table containing a pattern of driving forces to be generated by the electromagnetic actuator in response to depression of the key and a pattern of driving forces to be generated by the electromagnetic actuator in response to release of the key, and the control section references the force sense imparting table in response to depression operation or release operation of the key to control the electromagnetic actuator in accordance with the pattern provided by the force sense imparting table.

8. The keyboard apparatus as claimed in claim 1, further comprising:

a coupling mechanism that couples the mass member and the transmission, wherein the coupling mechanism comprises a magnet fixed to one of the mass member or the transmission member and an attraction member attractable to the magnet fixed to the other of the mass member or the transmission member.

9. The keyboard apparatus as claimed in claim 8, wherein:

one of the magnet or the attraction member angularly moves in response to movement of the mass member or the transmission member, while the other of the magnet or the attraction member linearly moves in response to movement of the transmission member or the mass member, and the magnet and the attraction member move along each other's surfaces in response to the movement of the mass member and the transmission member.

10. The keyboard apparatus as claimed in claim 8, wherein at least one of a surface of the magnet abutting against the attraction member or a surface of the attraction member abutting against the magnet is formed in a curved shape.

11. The keyboard apparatus as claimed in claim 9, wherein at least one of the surface of the magnet abutting against the attraction member or the surface of the attraction member abutting against the magnet is formed in a curved shape.

* * * * *